US009724933B2

(12) United States Patent
McNestry et al.

(10) Patent No.: US 9,724,933 B2
(45) Date of Patent: Aug. 8, 2017

(54) THERMAL TRANSFER PRINTER

(75) Inventors: Martin McNestry, Heanor (GB); Steven Buckby, East Bridgford (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 13/586,157

(22) Filed: Aug. 15, 2012

(65) Prior Publication Data

US 2013/0215210 A1 Aug. 22, 2013

Related U.S. Application Data

(60) Provisional application No. 61/523,474, filed on Aug. 15, 2011.

(51) Int. Cl.

| | |
|---|---|
| ***B41J 33/16*** | (2006.01) |
| ***B41J 2/325*** | (2006.01) |
| ***B41J 35/36*** | (2006.01) |
| ***B41J 25/312*** | (2006.01) |
| ***B41J 33/14*** | (2006.01) |
| ***B41J 33/34*** | (2006.01) |
| ***B41J 33/36*** | (2006.01) |
| ***B41J 33/54*** | (2006.01) |

(52) U.S. Cl.

CPC ..... *B41J 2/325* (2013.01); *B41J 25/312* (2013.01); *B41J 33/14* (2013.01); *B41J 33/34* (2013.01); *B41J 33/36* (2013.01); *B41J 33/54* (2013.01); *B41J 35/36* (2013.01)

(58) Field of Classification Search

USPC ..... 347/211, 171–178; 400/247, 249

See application file for complete search history.

(56) References Cited

U.S. PATENT DOCUMENTS

| | | | | |
|---|---|---|---|---|
| 3,715,641 A | | 2/1973 | Mattes | |
| 4,630,069 A | * | 12/1986 | Erlichman | B41M 5/345 346/105 |
| 4,797,016 A | * | 1/1989 | Lahr | 400/237 |
| 4,924,240 A | | 5/1990 | Herbert | |
| 5,009,531 A | | 4/1991 | Koike | |
| 5,185,315 A | | 2/1993 | Sparer | |
| 5,206,662 A | | 4/1993 | Fox | |
| 5,294,203 A | * | 3/1994 | Williams | 400/234 |
| 5,305,020 A | | 4/1994 | Gibbons | |

(Continued)

FOREIGN PATENT DOCUMENTS

| | | |
|---|---|---|
| CN | 1843760 | 10/2006 |
| EP | 0213934 | 3/1987 |

(Continued)

*Primary Examiner* — Matthew Luu
*Assistant Examiner* — Lily Kemathe
(74) *Attorney, Agent, or Firm* — Robert L. Wolter; Beusse, Wolter, Sanks & Maire PLLC

(57) ABSTRACT

A thermal transfer printer, including first and second spool supports each being configured to support a spool of ribbon; a ribbon drive configured to cause movement of ribbon from the first support to the second spool support; a printhead for selectively transferring ink from the ribbon to a substrate; an electromagnetic sensor arranged to sense electromagnetic radiation and to generate data indicative of a property of the ribbon based upon sensed electromagnetic radiation; and a controller for processing data generated by the electromagnetic sensor.

18 Claims, 10 Drawing Sheets

(56) References Cited

U.S. PATENT DOCUMENTS

| | | | | |
|---|---|---|---|---|
| 5,385,416 | A | 1/1995 | Maekawa | |
| 5,445,463 | A | 8/1995 | Paranjpe | |
| 5,445,464 | A * | 8/1995 | Asakura et al. | 400/249 |
| 5,455,617 | A | 10/1995 | Stephenson | |
| 5,501,537 | A * | 3/1996 | Kohno | 400/240.4 |
| 5,612,727 | A | 3/1997 | Morimoto | |
| 5,788,388 | A * | 8/1998 | Cowger et al. | 400/703 |
| 5,821,975 | A | 10/1998 | Guenther | |
| 5,853,255 | A | 12/1998 | Soshi | |
| 5,957,594 | A * | 9/1999 | Loidl | 400/237 |
| 5,978,005 | A | 11/1999 | Hadley | |
| 6,059,469 | A * | 5/2000 | Hirumi | 400/208 |
| 6,076,982 | A * | 6/2000 | Katsuno | 400/242 |
| 6,315,471 | B1 * | 11/2001 | Hsieh | B41J 35/08 347/172 |
| 6,380,965 | B1 | 4/2002 | Sims | |
| 6,676,312 | B2 * | 1/2004 | Richard | 400/242 |
| 6,767,147 | B2 * | 7/2004 | Jakubowski et al. | 400/249 |
| 7,150,572 | B2 | 12/2006 | McNestry | |
| 7,258,502 | B2 * | 8/2007 | Nagae et al. | 400/611 |
| 7,553,096 | B2 * | 6/2009 | Mindler | 400/240 |
| 7,753,605 | B2 * | 7/2010 | McNestry et al. | 400/223 |
| 8,317,421 | B2 * | 11/2012 | McNestry | 400/234 |
| 8,328,441 | B2 * | 12/2012 | McNestry et al. | 400/120.01 |
| 2001/0001627 | A1 | 5/2001 | Kobayashi | |
| 2001/0046062 | A1 * | 11/2001 | Miyazaki | 358/1.14 |
| 2002/0181990 | A1 | 12/2002 | Richard | |
| 2003/0210321 | A1 | 11/2003 | Rother | |
| 2004/0146331 | A1 * | 7/2004 | McNestry et al. | 400/615.2 |
| 2006/0171757 | A1 * | 8/2006 | Berson | G06K 19/07718 400/279 |
| 2006/0198682 | A1 | 9/2006 | Tsuchiya | |
| 2006/0239744 | A1 * | 10/2006 | Hideaki | 400/249 |
| 2007/0182807 | A1 | 8/2007 | Sawada | |
| 2008/0175621 | A1 | 7/2008 | Furuya | |
| 2008/0219741 | A1 * | 9/2008 | McNestry et al. | 400/234 |
| 2008/0219742 | A1 * | 9/2008 | McNestry et al. | 400/234 |
| 2010/0135709 | A1 * | 6/2010 | McNestry et al. | 400/236 |
| 2010/0172682 | A1 | 7/2010 | Hart | |
| 2010/0239348 | A1 | 9/2010 | Yamaguchi | |
| 2011/0081189 | A1 * | 4/2011 | Okuno | 400/619 |
| 2011/0292150 | A1 | 12/2011 | Ishii | |
| 2012/0176460 | A1 | 7/2012 | Mochizuki | |
| 2013/0215210 | A1 | 8/2013 | McNestry | |
| 2014/0292991 | A1 | 10/2014 | Aihara | |

FOREIGN PATENT DOCUMENTS

| | | | |
|---|---|---|---|
| EP | 0714782 | A1 | 6/1996 |
| EP | 0955174 | A2 | 11/1999 |
| EP | 0955178 | A2 | 11/1999 |
| EP | 1066975 | A1 | 1/2001 |
| JP | 2007008040 | | 1/2007 |
| JP | 2012011569 | | 1/2012 |
| WO | WO2008/107650 | | 9/2008 |

* cited by examiner

Good print

Fixed pixel[1]

Printhead pressure drop

Misaligned printhead

THERMAL TRANSFER PRINTER

CROSS REFERENCE TO RELATED APPLICATIONS

This application claims priority to U.S. Provisional Application No. 61/523,474 filed Aug. 15, 2011, and incorporated herein by reference in its entirety.

BACKGROUND

The present disclosure relates to thermal transfer printers and particularly but not exclusively to methods for monitoring and controlling the quality of printed images.

Slip mode printing, as described in PCT WO97/36751 and later in PCT WO99/34983, is a known method of thermal transfer printing in which the printer controller controls the motion of the thermal transfer ribbon to be at a speed which is, to a chosen extent, less than the speed of the substrate to be printed on, whilst in the same process, controlling the signals to the thermal transfer printhead to print an image which is similarly reduced in size in the same plane as the direction of movement of the ribbon and substrate, so that as the thermal transfer prints, the ink is to some extent "smeared" onto the substrate. The desired result is that a full sized image is printed on the substrate, but the amount of ribbon consumed is less than the full size of the image, in the plane of the direction of movement of the ribbon and substrate.

There are two generally known modes of thermal transfer printing—continuous printing and intermittent printing. In both modes of printing, a printer performs a regularly repeated series of printing cycles, each cycle including a printing phase during which ink is being transferred to a substrate, and a further non-printing phase during which the apparatus is prepared for the printing phase of the next cycle.

In continuous printing, during the printing phase a stationary printhead is brought into contact with a printer ribbon the other side of which is in contact with a substrate on to which an image is to be printed. (The term "stationary" is used in the context of continuous printing to indicate that although the printhead will be moved into and out of contact with the ribbon, it will not move relative to the ribbon path in the direction in which ribbon is advanced along that path). Both the substrate and printer ribbon are transported past the printhead, generally but not necessarily at the same speed. Generally only relatively small lengths of the substrate which is transported past the printhead are to be printed upon and therefore to avoid gross wastage of ribbon it is necessary to reverse the direction of travel of the ribbon between printing operations to avoid ribbon wastage as is described in further detail below. Thus in a typical printing process in which the substrate is travelling at a constant velocity, the printhead is extended into contact with the ribbon only when the printhead is adjacent regions of the substrate to be printed. Immediately before extension of the printhead, the ribbon is accelerated up to a desired speed which may in normal operation be the speed of travel of the substrate. The ribbon speed is then maintained at the constant speed during the printing phase and, after the printing phase has been completed, the ribbon is decelerated and then driven in the reverse direction so that the used region of the ribbon is on the upstream side of the printhead. As the next region of the substrate to be printed approaches, the ribbon is then accelerated back up to the normal printing speed and the ribbon is positioned so that an unused portion of the ribbon close to the previously used region of the ribbon is located between the printhead and the substrate when the printhead is moved to the printing position. Thus very rapid acceleration and deceleration of the ribbon in both directions is desirable, and the ribbon drive system is ideally capable of accurately locating the ribbon so as to avoid a printing operation being conducted when a previously used portion of the ribbon is interposed between the printhead and the substrate.

In intermittent printing, a substrate is advanced past a printhead in a stepwise manner such that during the printing phase of each cycle the substrate and generally, but not necessarily, the ribbon, are stationary. Relative movement between the substrate, ribbon and printhead is achieved by displacing the printhead relative to the substrate and ribbon. Between the printing phase of successive cycles, the substrate is advanced so as to present the next region to be printed beneath the printhead and the ribbon is advanced so that an unused section of ribbon is located between the printhead and the substrate. Once again rapid and accurate transport of the ribbon is desirable to ensure that unused ribbon is always located between the substrate and printhead at a time that the printhead is advanced to conduct a printing operation.

Some commercially available thermal transfer printers are configured to operate in only one of intermittent and continuous modes. That is, the mode in which the printer operates is determined by constructional features of the printer. Other commercially available thermal transfer printers provide functionality such that a user can select either an intermittent mode of operation or a continuous mode of operation at runtime.

BRIEF SUMMARY

The present disclosure provides a thermal transfer printer including a system for monitoring and controlling the quality of printed images.

According to a first aspect of the present disclosure, there is provided a thermal transfer printer, comprising first and second spool supports each being configured to support a spool of ribbon; a ribbon drive configured to cause movement of ribbon from the first support to the second spool support; a printhead for selectively transferring ink from the ribbon to a substrate; an electromagnetic sensor for generating data indicative of a property of the ribbon; and a controller for processing data generated by the electromagnetic sensor.

The first aspect therefore provides a thermal transfer printer in which data indicating a property of the ribbon is generated and this data is subsequently processed by a controller. The data indicative of the property of the ribbon may be generated from the ribbon in a location between the first and second spools. The location may be between the printhead and the second spool which acts as a take-up spool.

The property of the ribbon may be selected from the group consisting of electromagnetic transmittance and electromagnetic reflectance. The electromagnetic transmittance and/or reflectance of the ribbon may be affected by the quantity of ink remaining on the ribbon and the data generated by the electromagnetic sensor may therefore be indicative of the quantity of ink remaining on the ribbon. For example, the electromagnetic transmittance of ribbon from which a relatively large quantity of ink has been removed is typically greater than that of a ribbon from which a relatively small quantity of ink has been removed. Similarly, the electromagnetic reflectance of ribbon may be affected by whether it includes a relatively large or relatively small quantity of ink.

The sensor may comprise a charge coupled device. The sensor may comprise a camera. Such a camera or charge coupled device may sense the electromagnetic reflectance of the ribbon.

The sensor may comprise an electromagnetic detector. Such a detector may provide an output indicating a quantity of electromagnetic radiation incident upon it.

The printer may further comprise a source of electromagnetic radiation for applying electromagnetic radiation to the ribbon. A ribbon path between the first and second spools may pass between said source of electromagnetic radiation and said electromagnetic sensor. The electromagnetic sensor may detect optical transmittance of electromagnetic radiation from the source of electromagnetic radiation to the electromagnetic sensor through the ribbon.

The electromagnetic radiation may be visible light, infrared radiation, ultraviolet radiation or radiation in any other part of the electromagnetic spectrum.

The controller may be configured to receive signals indicative of an image that is intended to be printed onto the substrate. In this way, the controller can process the received signals alongside the data generated by the electromagnetic sensor. Such processing may allow the controller to determine whether (or how well) the data generated by the electromagnetic sensor matches that which would be expected given the image which was intended to be printed.

Processing data generated by the electromagnetic sensor may comprise generating data indicating whether a printed image has acceptable quality.

The electromagnetic sensor may be configured for generating data based upon a property of the ribbon after ink has been transferred to the substrate. For example, the electromagnetic sensor may be located adjacent a part of a ribbon path between the two spools which is between the printhead and the take up spools so as to generate images from "printed" ribbon.

The first and second spool supports may be driven by respective motors. The motors may take any suitable form and be controlled in any convenient way. The motors may be position controlled motors, such as open loop position controlled motors. One example of an open loop position control motor is a stepper motor. In some embodiments two stepper motors are used, one each spool of tape. Each motor may be energized so as to drive its respective spool in the direction of tape transport. Tension in the tape between the spools may be monitored using any convenient method. For example a tension sensing element (e.g. a loadcell) may be located in the tape path between the spools. Alternatively, tension in the tape may be determined by monitoring the power supplied to one or both of the motors. It will be appreciated that various tension monitoring techniques are known in the art and these can be applied in various embodiments of printers according to the present disclosure.

The controller may be configured to control properties of the printer based on data generated by the electromagnetic sensor. For example, the property of the printer may be selected from a printhead pressure parameter (e.g. how much pressure is exerted by the printhead on ribbon and substrate against a printing surface), a printhead angle parameter (e.g. an angle at which the printhead approaches the ribbon), a printhead position parameter (e.g. a position of the printhead along a path extending generally parallel to the ribbon parth), print speed, and printhead temperature. It will be appreciated that any parameter of the printer may be controlled by the controller.

The electromagnetic sensor may be configured to read data from the ribbon, the data conveying information about the properties of the ribbon. The data may take the form of a code which is suitable for processing by the controller. The data may be expressed in the form of human readable and/or machine readable data. The data may comprise a barcode, such as a one-dimensional or two-dimensional barcode.

The properties of the ribbon may be selected from ribbon length, ribbon width, thickness, color, and ink type. In some embodiments, instead of obtaining ribbon width information by reading a code, an image of the ribbon may be generated using the electromagnetic sensor and the width of the ribbon may be determined from the manner in which the ribbon appears in the image generated by the electromagnetic sensor.

The controller may be configured to determine a diameter of at least one of the spools of tape supported by the spool supports based upon data generated by the electromagnetic sensor. The data generated by the optical device may comprise data generated by sensing at least two marks disposed a predetermined distance apart along a length of the ribbon. The controller may be configured to monitor rotation of the at least one of the spools to generate rotation data. Such monitoring may involve monitoring control pulses provided to a motor turning the at least one of the spools (e.g. monitoring step pulses provided to a stepper motor). The controller may determine a diameter of the at least one of the spools by processing data generated by sensing at least two marks disposed a predetermined distance apart along the length of the ribbon together with said rotation data.

According to a second aspect of the present disclosure, there is provided a system for determining the quality of an image printed by a thermal transfer printer. The printer comprising first and second spool supports each being configured to support a spool of ribbon, a ribbon drive configured to cause movement of ribbon from the first support to the second spool support and a printhead for selectively transferring ink from the ribbon to a substrate. The system comprises an electromagnetic sensor for generating data based upon a property of the ribbon; and a controller for processing data generated by the electromagnetic sensor to generate data indicating the quality of the image printed by the thermal transfer printer.

Any features discussed above in the context of the first aspect of the present disclosure can be appropriately applied to the second aspect of the present disclosure.

According to a third aspect of the present disclosure, there is provided a method for monitoring the quality of a printed image of a thermal transfer printer. The method comprises providing a ribbon; providing at least one spool configured to take up the ribbon; providing a printhead for selectively transferring ink from the ribbon to a substrate; capturing data generated by an electromagnetic sensor arranged to sense a property of the ribbon; and processing the captured data to control at least one property of the printer.

The property of the ribbon may be selected from the group consisting of electromagnetic transmittance and electromagnetic reflectance.

Capturing data may comprise capturing data generated by the electromagnetic sensor from the ribbon after ink has been transferred to the substrate. Alternatively or additionally, capturing data may comprise capturing data generated by the electromagnetic sensor from the ribbon after the ribbon has been inserted into the printer but prior to printing with the ribbon.

The at least one property of the printer may be a pressure of the printhead against the ribbon during printing (e.g. a pressure exerted by the printhead against the ribbon and substrate and a surface on which printing occurs).

The at least one property of the printer may be selected from print speed and printhead temperature or another of the parameters detailed above.

The method may further comprise determining the diameter of at least one spool of ribbon based upon data captured from the ribbon. The ribbon may comprise at least two marks disposed a predetermined distance apart along a length of the ribbon.

The printhead may comprise selectively energizeable heating elements. The at least one property of the printer may be the energy provided to the selectively energizeable heating elements.

The method may further comprise controlling properties of the printer to adjust the darkness of printed images.

The method may further comprise receiving signals which are indicative of the image that is intended to be printed. A comparison between first data from the signals indicative of the image intended to be printed and second data received from data captured from the ribbon after ink has been transferred to the substrate may be performed.

The method may further comprise providing an output which indicates a level of conformity between the first data and the second data.

The method may comprise providing an indication of the accuracy of what has actually been printed by the printhead, compared to what was intended to be printed by the printhead. For example, it may be determined whether a pixel is faulty (i.e. inoperable) or operational but not functioning correctly because of a buildup of ink on the printhead. In the former case replacement of the printhead may be required. In the latter case a cleaning operation may be required.

The method may further comprise comparing the second data to third data indicative of the resistivity of pixels of the printhead to determine the status of pixels of the printhead.

The method may further comprise using the captured data to determine the lateral location of the ribbon.

According to another aspect, there is provided a method for operating a thermal transfer printer, comprising providing a ribbon; providing at least one spool configured to take up the ribbon; providing a printhead; moving the substrate relative to the printhead; moving the ribbon relative to the printhead at a speed that is less than the speed of the substrate while using the printhead to selectively transfer ink from the ribbon to a substrate; capturing data from the ribbon after ink has been transferred to the substrate; and processing the data to control at least one property of the printer.

In this way, a property of the printer is controlled based upon data obtained from the ribbon after printing. In some embodiments, data obtained from the ribbon after printing is indicative of print quality and as such a property of the printer can be controlled based upon determined print quality.

Movement of the ribbon relative to the printhead at a speed that is less than the speed of the substrate enables so called "slip printing" of the type described above.

The method may comprise controlling the pressure of the printhead against the ribbon and the substrate. For example, the at least one property of the printer controlled based upon the captured data may be the pressure of the printer against the ribbon and the substrate.

A closed loop control method may be provided which adjusts the printhead pressure (or other printer parameters) in response to feedback signals derived from the data captured from the ribbon after ink has been transferred to the substrate. This is advantageous as it allows real time control of the printer based upon data captured from the ribbon after printing. That is, in some embodiments the disclosure provides for closed loop slip printing. This is advantageous as it allows possible disadvantages of slip printing (such as variable print quality arising from subtle changes in printing configuration) to be overcome. It will be appreciated that in addition to using feed back signatures derived from the data captured from the ribbon, other feed back signals may also be used. For example, the pressure of the printhead against the ribbon and substrate may be monitored and used to control one or more parameters of the printer.

The method may further comprise determining whether the printhead pressure is within predetermined limits, and maintaining the printhead pressure at a level which delivers acceptable print quality based on predetermined criteria within the predetermined printhead pressure limits.

The printhead may comprise selectively energizeable heating elements. The at least one property of the printer may be the energy provided to the selectively energizeable heating elements.

The method may further comprise controlling properties of the printer to adjust darkness of the images.

The method may further comprise receiving signals from the printhead which are indicative of the image that is intended to be printed onto the substrate. Additionally, a comparison between first data from the signals indicative of the image intended to be printed by the printhead and second data received from the images captured from the ribbon after ink has been transferred to the substrate may be performed. In this way, the controller may determine a likely quality of the printed image.

The method may comprise providing an output which indicates a level of conformity between the first data and the second data.

The method may comprise providing an indication of the accuracy of what has actually been printed by the printhead, compared to what was intended to be printed by the printhead.

In another aspect, the present disclosure provides a thermal transfer printer, comprising first and second spool supports each being configured to support a spool or ribbon; a ribbon drive configured to cause movement of ribbon from the first support to the second spool support; a printhead for selectively transferring ink from the ribbon to a substrate; and a controller configured to control the ribbon drive to move the ribbon relative to the printhead at a speed that is less than a speed at which a substrate passes the printhead while using the printhead to selectively transfer ink from the ribbon to the substrate. The controller is further arranged to receive data obtained from the ribbon after ink has been transferred to the substrate and to process the data to control at least one property of the printer.

The first and second spool supports may be driven by respective motors. The motors may take any suitable form and be controlled in any convenient way. The motors may be position controlled motors, such as open loop position controlled motors. One example of an open loop position control motor is a stepper motor. In some embodiments two stepper motors are used, one each spool of tape. Each motor may be energized so as to drive its respective spool in the direction of tape transport. Tension in the tape between the spools may be monitored using any convenient method. For example a tension sensing element (e.g. a loadcell) may be located in the tape path between the spools. Alternatively, tension in the tape may be determined by monitoring the power supplied to one or both of the motors. It will be appreciated that various tension monitoring techniques are known in the art and these can be applied in various embodiments of printers according to the present disclosure.

The controller may be operable to vary the speed of ribbon movement based upon the processed data. That is, for a given speed of substrate movement, the speed of ribbon movement may be selected based upon the processed data. In this way, the relative difference between ribbon speed and substrate speed (or degree of slip) may be varied in a dynamic manner.

According to another aspect of the disclosure, there is provided a thermal transfer printer comprising first and second spool supports each being configured to support a spool of ribbon; a ribbon drive configured to cause movement of ribbon from the first spool support to the second spool support; a printhead for selectively transferring ink from the ribbon to a substrate; and a motor coupled to the printhead and arranged to vary the position of the printhead relative to a surface against which printing is carried out to thereby control the pressure exerted by the printhead on the surface; wherein the printhead is rotatable about a pivot and the motor is arranged to cause rotation of the printhead about the pivot to vary the position of the printhead relative to the surface.

The use of a motor coupled to the printhead and arranged to vary the position of the printhead relative to a surface against which printing is carried out (which may be a roller or a flat surface) to thereby control the pressure exerted by the printhead on the surface allows printing to be optimized in certain ways. That is, the pressure exerted by the printhead can have a material affect on the quality of a printed image and providing a motor arranged to vary printhead position can provide accurate pressure control thereby allowing print quality to be optimized.

The motor may be coupled to the printhead via a flexible linkage, such as a belt. That is, in some embodiments it is useful to provide some compliance (or elasticity) in the coupling between the motor and printhead.

The belt may pass around a roller driven by the motor such that rotation of the motor causes movement of the belt, movement of the belt causing the rotation of the printhead about the pivot. In some embodiments, the belt may move along an at least partially linear path, the printhead being mounted to a component coupled with the belt and configured for movement with the belt along the path wherein the movement of the component along the path causes rotation of the printhead about the pivot.

The belt may pass around a further roller, and the pivot may be coaxial with the further roller. That is, the printhead may pivot about an axis of the further roller.

The printer may further comprise a printhead drive mechanism for transporting the printhead along a track extending generally parallel to the predetermined substrate transport path. Such movement of the printhead may be required where intermittent printing is carried out. Such movement may be useful in allowing the position of the printhead to be varied where continuous printing is carried out.

The printer may further comprise a controller arranged to control the motor to control rotation of the printhead about the pivot. The controller may configured to monitor a parameter of the motor. The parameter may be the power supplied to the motor. The motor may take any convenient form, but in one embodiment the motor is a stepper motor.

Where a stepper motor is used to cause pivoting of the printhead, the stepper motor may be driven by a motor drive circuit and the controller may be configured to monitor the power supplied to the motor drive circuit. In some embodiments such monitoring may be carried out by monitoring a parameter indicative of the power supplied, for example monitoring a parameter having a known relationship to the power supplied to the motor drive circuit. The power supplied to the motor drive circuit may be considered to be indicative of (or substantially the same as) the power supplied to the motor.

The controller may be configured to compare the monitored parameter to a threshold. The threshold may be selected such as to allow the controller to determine whether the printhead has contacted the surface. That is, the parameter may show a sharp increase when the printhead contacts the surface and this increase may be determined by comparison with a threshold. Alternatively, a rate of change of the monitored parameter may be determined, and a detection of rate of change exceeding a predetermined rate of change may be considered to indicate that the printer has contacted the surface.

The printer may be arranged to cause further rotation of the printhead after contact of the printhead with the surface. Such further rotation may cause the pressure exerted by the printhead on the surface to increase.

The further rotation may be predetermined further rotation. That is, the further rotation may involve turning the stepper motor through a predetermined number of steps.

Alternatively, the further rotation may be based upon a monitored parameter such as the pressure exerted by the printhead on the surface. Pressure may be monitored in any convenient way, including by using a loadcell (or other suitable mechanism for measuring force or pressure) arranged to measure the pressure exerted on the surface. That is, a pressure exerted by the printhead on the surface may be monitored and such monitoring may be used to control further rotation of the printhead with the intention of ensuring that the printhead exerts a desired pressure on the surface.

The controller may be arranged to control rotation of the printhead about the pivot based upon a monitored parameter (such as monitored pressure).

According to another aspect of the disclosure there is provided a thermal transfer printer comprising: first and second spool supports each being configured to support a spool of ribbon; a ribbon drive configured to cause movement of ribbon from the first support to the second spool support; a printhead for selectively transferring ink from the ribbon to a substrate; a first and second motor; a printhead drive mechanism for transporting the printhead along a track extending generally parallel to the predetermined substrate transport path and for displacing the printhead into and out of contact with the ribbon; and a printhead pressure control mechanism for controlling the pressure of the printhead against the ribbon and the substrate along a plurality of discrete pressure settings.

The printhead drive mechanism may comprise a first belt operably connected to the printhead and extending generally parallel to the predetermined substrate transport path; a first motor for controlling the first belt; a second belt operably connected to the printhead and extending generally parallel to the first belt; a second motor for controlling the second belt; and a pivoting mechanism driven by the second belt; wherein the pressure of the printhead exerted on the ribbon is controlled by moving the second belt.

The pivoting mechanism may comprise a base that engages the first belt, a first arm pivotally connected to the base and engaged with the second belt, and a second arm. The printhead may be disposed on the second arm. At least one of the first motor and the second motor may be a stepper motor, although any convenient motor can be used.

The printer may further comprise an optical device for capturing images from the used ribbon after leaving the printhead. Such an optical device can take any suitable form and can be arranged to capture any data from used ribbon. Such a device can be sensitive to electromagnetic radiation such as visible light. The optical device may be configured to provide feedback signals to the controller.

According to another aspect of the present disclosure there is provided a thermal transfer printer comprising first and second spool supports each being configured to support a spool of ribbon; a ribbon drive configured to cause movement of ribbon from the first spool support to the second spool support; a printhead for selectively transferring ink from the ribbon to a substrate; a motor coupled to the printhead and arranged to vary the position of the printhead relative to a surface against which printing is carried out to thereby control the pressure exerted by the printhead on the surface; and a monitor arranged to monitor whether the printhead has arrived in a predetermined position relative to the surface.

In this way, a printer is provided in which it can be determined whether the printhead is in a known relationship to the printing surface. Such a known relationship may be defined by contact between the printhead and the printing surface or by the exercise of a particular pressure by the printhead on the printing surface. It has been found that monitoring whether the printhead has achieved a predetermined position relative to the printing surface allows for better positioning of the printhead and in some embodiments better quality print.

The monitor may be arranged to monitor whether the printhead has contacted the surface. The monitor may be further arranged to generate data indicating a pressure exerted by the printhead on the surface.

Movement of the motor may be based at least partially upon an output of the monitor.

It will be appreciated that the aspects of the disclosure detailed above may be combined in any convenient way. In particular, to the extent that it is appropriate it is foreseen that optional features described in the context of one aspect of the disclosure can be applied to another aspect of the disclosure.

The invention can be implemented in any convenient way. In particular, where processing is described herein it is envisaged that such processing could be performed by an appropriately programmed microprocessor. As such, further aspects of the disclosure provide computer readable media (which may be tangible or intangible media) carrying computer readable instructions arranged to control a microprocessor to carry out processing described herein.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
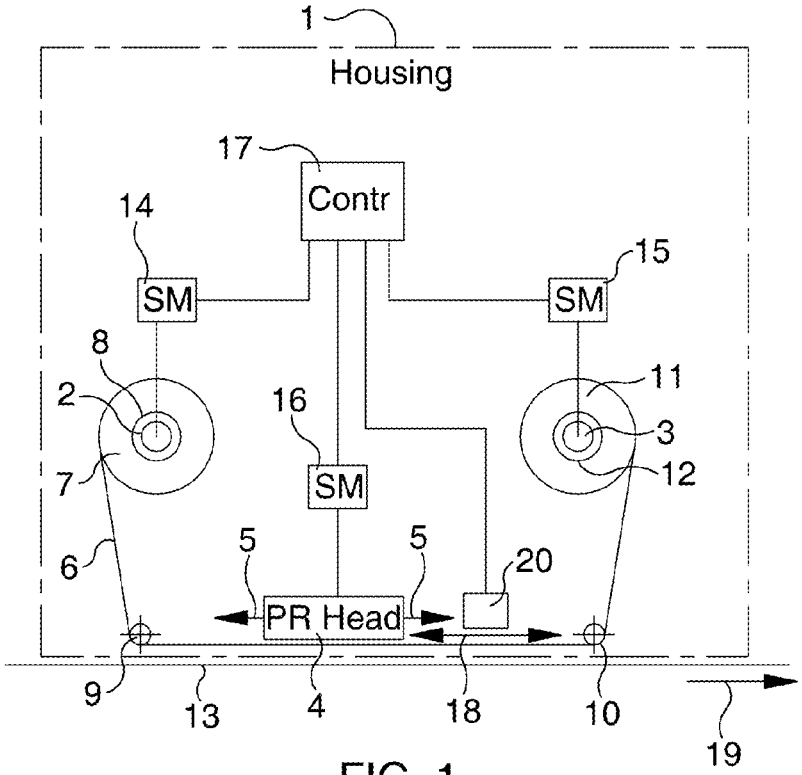
FIG. 1 is a view of a first embodiment of a printer system with an optical device.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a method and apparatus to provide a quality assurance indication of the images printed by a thermal transfer printer or overprinter. In thermal transfer printing, a ribbon (which is also referred to in the art as 'tape') is wound around a path between a supply spool and a rewind (or take-up) spool. In the ribbon path is mounted a thermal printhead operated to print ink onto an adjacent substrate. During printing, some or all of the ink from sections of the ribbon is removed, resulting in a "negative" image on the ribbon in the section of the ribbon path between the printhead and the rewind spool (the "spent" section of the ribbon path).

An embodiment of such a system is shown in FIG. 1. The thermal transfer printer shown in FIG. 1 is disclosed in U.S. Pat. No. 7,150,572, the contents of which are incorporated by reference. However, the print monitoring system may be used with any suitable printer system. Referring to FIG. 1, the schematically illustrated printer has a housing represented by broken line 1 supporting a first shaft 2 and a second shaft 3. A displaceable printhead 4 is also mounted on the housing, the printhead being displaceable along a linear track as indicated by arrows 5. The printhead 4 preferably contains selectively energizeable heating elements; during printing, ink on the ribbon adjacent to energized heating elements is melted and transferred to a substrate. A printer ribbon 6 extends from a spool 7 received on a spool support 8 which is driven by the shaft 2 around rollers 9 and 10 to a second spool 11 supported on a spool support 12 which is driven by the shaft 3. The path followed by the ribbon 6 between the rollers 9 and 10 passes in front of the printhead 4. A substrate 13 upon which print is to be deposited follows a parallel path to the ribbon 6 between rollers 9 and 10, the ribbon 6 being interposed between the printhead 4 and the substrate 13.

The shaft 2 is driven by a stepper motor 14 and the shaft 3 is driven by a stepper motor 15. A further stepper motor 16 controls the position on its linear track of the printhead 4. A controller 17 controls each of the three stepper motors 14, 15 and 16, the stepper motors being capable of driving the print ribbon 6 in both directions as indicated by arrow 18. In the configuration illustrated in FIG. 1, the spools 7 and 11 are wound in the same sense as one another and thus rotate in the same rotational direction to transport the ribbon although it will be appreciated that this need not be the case. In some embodiments each motor is energized to drive its respective spool in the direction of tape transport. That is, the motors are arranged to push-pull drive the spools of tape.

The shaft 2 may be driven by the stepper motor 14 in any convenient way. For example in one embodiment a drive coupling of fixed transmission ratio is provided between the shaft 2 and the output shaft of the stepper motor 14. This can be arranged, for example, either by way of a belt drive or where the shaft 2 is itself the output shaft of the stepper motor 14. A gearbox may be provided between the output shaft of the stepper motor 14 and the shaft 2. The shaft 3 may be driven by the stepper motor 15 using similar arrangements.

In one embodiment, the printer includes an electromagnetic sensor arranged to sense electromagnetic radiation and to generate data indicative of a property of the ribbon based upon sensed electromagnetic radiation. In one embodiment, the electromagnetic sensor is an optical device 20, which may be a camera such as a line scan camera or area camera, to capture images of the thermal transfer ribbon. The optical device 20 captures one or more images of the "negative" image or images on the spent sections of the ribbon. The images of the spent ribbon give an indication of the quality of the image printed on the substrate. For example, if the negative image on the ribbon is too dark, that means the printhead 4 is not transferring sufficient ink to the substrate (that is, too much ink remains on the substrate after printing), which may occur, for example, if the printhead 4 is not pressing hard enough against the ribbon 6, or if the printhead 4 is malfunctioning. The images captured by the optical device 20 are received by a controller 17 which processes the images.

Figure 1A:
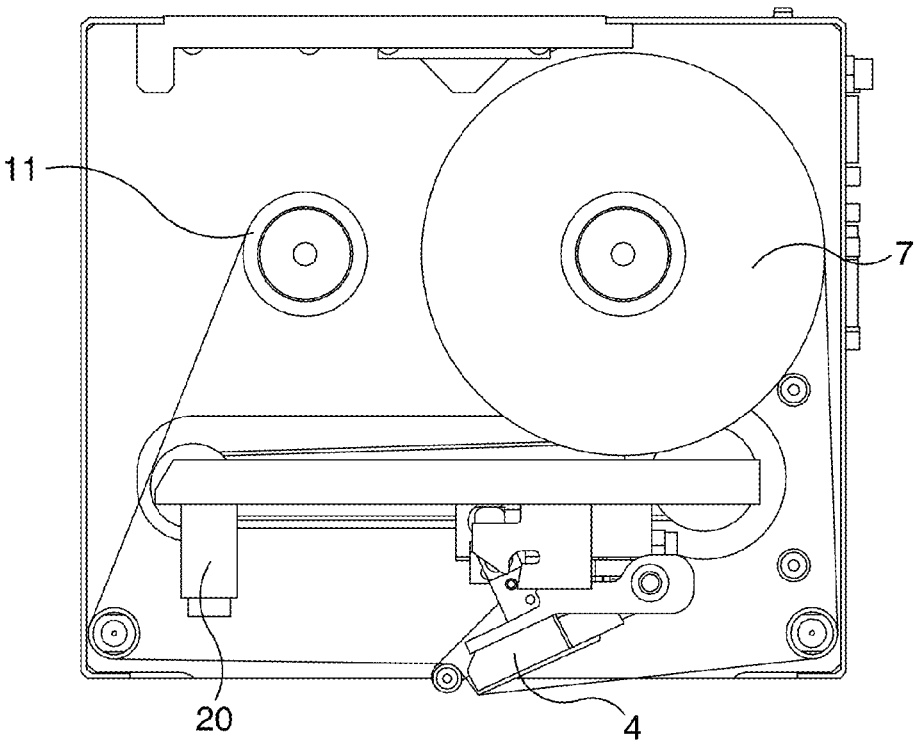
FIG. 1A is an alternative view of the printer system of FIG. 1.

FIG. 1A shows an alternative view of the printer of FIG. 1 and the camera 20 can again be seen. In the view of FIG. 1A, ribbon is transported from the spool 7 to the spool 11 past the print head 4.

In certain embodiments, an illumination source may be used to aid the optical device 20 in capturing images on the ribbon. The illumination source may provide constant illumination. Alternatively and/or additionally, a flash illumination source may be used.

Figure 2:
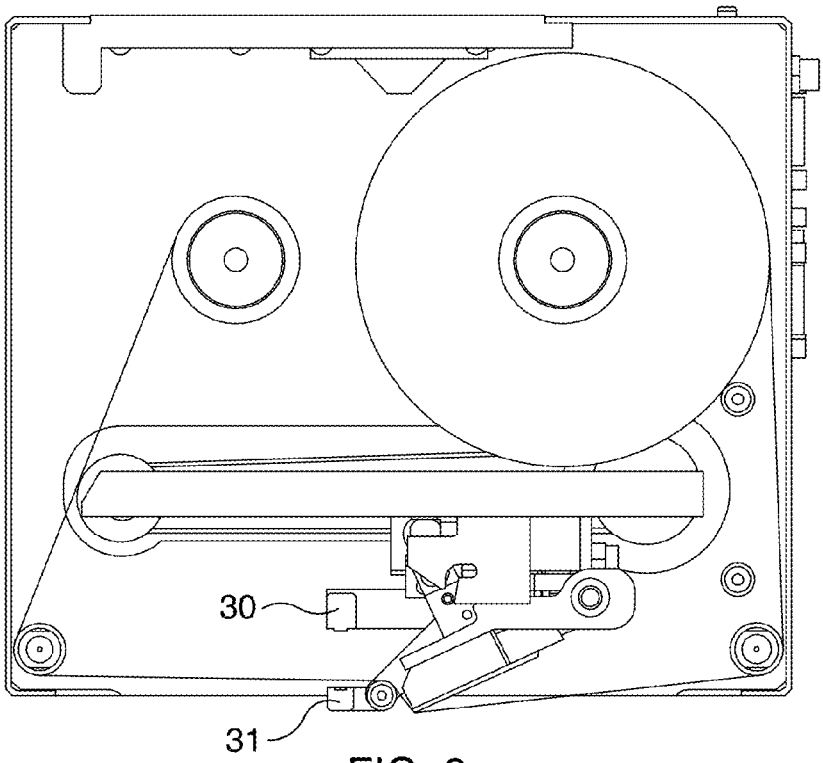
FIG. 2 is a view of a second embodiment of a printer system with an optical device.

In another embodiment, as shown in FIG. 2, the optical device includes optical detectors such as linear optical detectors 30. The optical detectors measure the optical transmittance of the ribbon after printing has occurred. The ribbon is illuminated by at least one light source 31, such as a light emitting diode. In one embodiment, the light source includes a plurality of high power super-red light emitting diodes. Where too much ink remains on the ribbon after printing less light than is expected will pass from the at least one light source 31 to the optical detectors 30 thereby providing an indication that printing is of an unacceptable quality.

An algorithm (described in further detail below) is used to measure the print quality and determine print errors. In particular, an algorithm compares the amount of ink remaining on the ribbon after printing has occurred (using data captured by the optical device 20 in the form of a camera in the embodiment of FIGS. 1 and 1A or by the optical detector 30 in the embodiment of FIG. 2) with the expected amount of ink which would remain after a good print has occurred. Any suitable algorithm may be used. For example, the expected total number of dots or pixels printed can be compared to the actual dots removed from the ribbon. In another embodiment, each individual dot printed can be compared to the corresponding actual dot removed from the ribbon. Alternatively, the print can be divided into regions (such as lines or other areas) and the sum or average value of a region can be compared between the expected image and the measured image on the ribbon.

The controller 17 may also receive signals which are indicative of the image that is intended to be printed onto the substrate. The controller 17 is programmed to perform a comparison between the data set received pertaining to the image intended to be printed by the printhead and the data set received from the images captured from the optical device and to provide an output which indicates a level of conformity between the two data sets. The output can be in analog or digital form. This method provides a means to provide an indication of the likely success and or accuracy of what has actually been printed by the printhead, compared to what was intended to be printed by the printhead.

The controller 17 is enabled to receive inputs which indicate a pre-determined level of acceptable conformity between the two data sets and the controller 17 is further optionally programmed to provide a further output which indicates whether any given conformity output, or succession of such outputs meet, exceed, or not the pre-determined level. By such method the controller 17 can further optionally provide "pass/fail" outputs and annunciations.

In more detail, where a camera is used to capture an image of the ribbon after printing as in FIGS. 1 and 1A, the captured image can be compared with a reference image. Such a comparison can be performed using any suitable image comparison algorithm. For example, the value of each pixel (i.e. 1 or 0) in the captured image can be compared with the value of each pixel (i.e. 1 or 0) in the reference image and the printing can be said to be acceptable only when a predetermined proportion of the pixels (which may be all of the pixels) have the same value. The reference image may be generated from the image to be printed by generating an inverse of the image to be printed in which each pixel having a value of '1' in the image to be printed has a value of '0' in the inverse image, and each pixel having a value of '0' in the image to be printed has a value of '1' in the inverse image.

The optical device described above has a variety of other uses. The optical device can check the ribbon either before printing or after printing. In one embodiment, the optical device can read a code on an inserted ribbon to obtain information about the properties of the ribbon or the desired operation of the printer. For example, the optical device can be used to scan a specially printed ribbon leader tape that includes a code or other readable indicia. The code may be encrypted or unencrypted. The code may be a 1D or 2D bar code, for example. The printer may use this code to provide information about the ribbon. Such ribbon information can include ribbon grade, width, length (e.g. to speed up calibration on new rolls of ribbon), age of ribbon, expiration date, supplier or brand, ink color, ink type, and the like. The printer may also use a code to provide recommended or default printer operating parameters, such as minimum or maximum speed, printhead pressure parameters, printhead temperature or energy information, and the like. Alternatively or additionally, the width of the ribbon (and other parameters of the ribbon) can be determined by processing an image of the ribbon itself without any need for the processing of a specific code.

The system can also use markings on the ribbon to provide a length measure on the ribbon, which can then be used to determine spool diameter. By way of background, when a new roll of ribbon is inserted into a printer, and where movement of the ribbon between the spools is effected by drive motors which respectively drive the supply and take up spools, the printer generally needs some way of determining the diameter of the ribbon supply spool and of the ribbon take up spool so that it can correlate rotational movement of the drive motors (e.g. steps of a stepper motor) to linear lengths of tape to be paid out or taken up. The optical device uses such markings on the ribbon to determine the spool diameters. In one embodiment, the ribbon includes at least two marks disposed a predetermined distance apart along a length of the ribbon. For example, the marks could be two printed bars or other images readable by the optical device. The marks could be portions of the ribbon with ink removed or partially removed, with different amounts of ink, or with different surface characteristics (such as sheen or texture) that are detectable by the optical device. These marks are used by the optical device to correlate a length of the ribbon with rotation of the motors. In some embodiments the marks may be made upon the ribbon (e.g. by printing a predetermined pattern) by the printer, assuming that there is sufficiently accurate control to allow the marks to be appropriately positioned a known distance apart. In other embodiments the marks may be made upon the ribbon during its production.

In further detail, if it is known that predetermined marks are included a known distance x apart on the ribbon, and if rotation of a spool (in terms of revolutions or part-revolutions) is monitored while tape travels through that known distance x past the optical device 20, a measure of spool diameter can be determined.

That is, it will be appreciated that where ribbon is paid out from or taken up onto a spool the following expression applies:

$$n\pi d = x \tag{1}$$

where: d is spool diameter; and n is a number of rotations (which need not be a whole number of rotations).

In one embodiment, where ribbon is taken up on the spool the diameter of which is to be determined, the spool can be driven through a predetermined angular distance by a stepper motor and a number of steps of the step motor applied to the spool to cause the ribbon to move through the distance x between the predetermined marks can be counted. Assuming a known ratio between steps of the stepper motor and one rotation of the spool it is a straightforward matter to determine a number of rotations n from the number of steps. As such, the only unknown in equation (1) is the diameter d and equation (1) can therefore be solved to provide an indication of spool diameter.

Alternatively, a spool the diameter of which is to be monitored may be coupled to a deenergised stepper motor. A motive force may then be applied to the other spool thereby causing rotation of the spool the diameter of which is to be measured. The Back-EMF generated by rotation of the deenergised stepper motor (e.g. by the pulling of tape caused by the motive force) can then be measured to provide a number of pulses corresponding to movement of the ribbon through the known distance x, there being a known number of pulses in a single revolution. The diameter of the spool of interest can then be calculated using the method described above. An electronic circuit to drive motors and measure BEMF pulses is now described.

Figure 3:
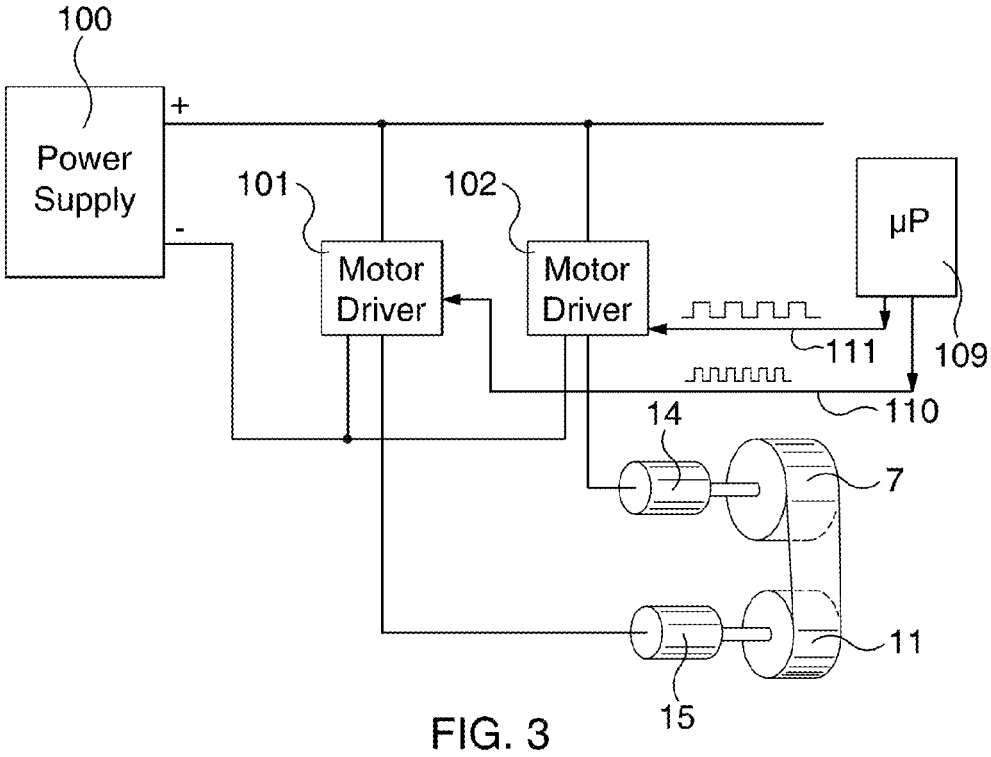
FIG. 3 is a schematic illustration of circuitry used to drive stepper motors in the printer system of FIGS. 1 and 2.

FIG. 3 shows a circuit for driving two stepper motors 14, 15, each of the stepper motors being arranged to drive a respective tape spool 7, 11. A constant voltage power supply 100 energises a first motor drive circuit 101 and a second motor drive circuit 102.

A microcontroller 109 delivers a pulsed output 110 to the first motor drive 101 and a pulsed output 111 to the second motor drive 102, each pulse of each pulsed output 110, 111 representing a step movement of the respective stepper motor. In one embodiment, each stepper motor comprises two quadrature-wound coils and current is supplied to the respective motor 14, 15 by the respective motor drive 101, 102 in sequence to one or both of the coils and in both senses (positive and negative) so as to achieve step advance of the motor shafts. As such, it will be appreciated that each of the motor drives 101, 102 may be connected to its respective stepper motor by four connections, two connections for each of the two coils. Alternatively, each stepper motor may comprise two unipolar centre-tapped coils, with current being supplied in only one sense (positive or negative). In such an embodiment each of the motor drives 101, 102 may be connected to its respective stepper motor by six connections, three connections for each of the two coils.

Figure 4:
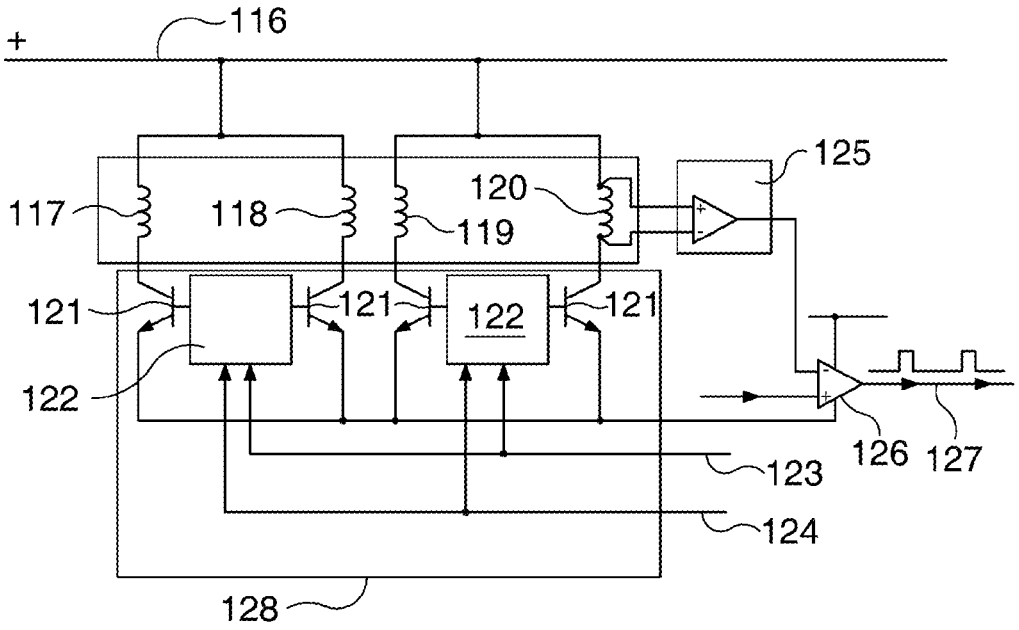
FIG. 4 is a schematic illustration showing part of the circuitry of FIG. 3 in further detail.

FIG. 4 illustrates part of the circuit of FIG. 3 suitable for driving unipolar coils in further detail. The positive supply rail 116 of the power supply 100 is arranged to supply current to four windings 117, 118, 119 and 120 of one of the motors. Current is drawn through the windings 117 to 120 by transistors 121 which are controlled by motor control and sequencing logic circuits 122. The step rate is controlled by an input on line 123 and drive is enabled or disabled by an input on line 124 (high value on line 124 enables, low value disables).

Where a motor is energized so as to drive its respective spool, the drive circuit for that motor is enabled and the number of steps through which the motor moves (and consequently the angle through which the motor moves) is known. Where a motor is deenergised the drive circuit for that motor is disabled (line 124 low). Thus a motor which is deenergized acts as a generator and a back-emf is generated across each of the motor windings 117 to 120. The components enclosed in box 128 of FIG. 4 correspond to one of the motor drive circuits 101, 102 of FIG. 3. The voltage developed across the winding 120 is applied to a level translator circuit 125 the output of which is applied to a zero crossing detector 126 fed with a voltage reference on its positive input. The output of the zero crossing detector 126 is a series of pulses on line 127. Those pulses are delivered to the microcontroller 109. These pulses provide an indication of angular movement of the deenergised stepper motor which can be used to determine spool diameter in the manner described above.

In another embodiment, the optical device analyzes the grey scale of the printed ribbon to determine quality of print. That is, a grey scale image of the ribbon after printing is acquired and analysed to determine print quality.

Data indicating quality of print, either alone or in combination with other data or feedback signals (e.g. information indicating tension in the ribbon or information indicating energy consumption by the printhead) can be used by the controller to adjust printer parameters. Such parameters can include printhead angle (i.e. the angle at which the printhead impacts a platen roller) and printhead pressure (i.e. the pressure exerted by the printhead on the platen roller). The adjustment of printhead pressure is described in further detail below. The adjustment of printhead angle is now described.

Figure 5:
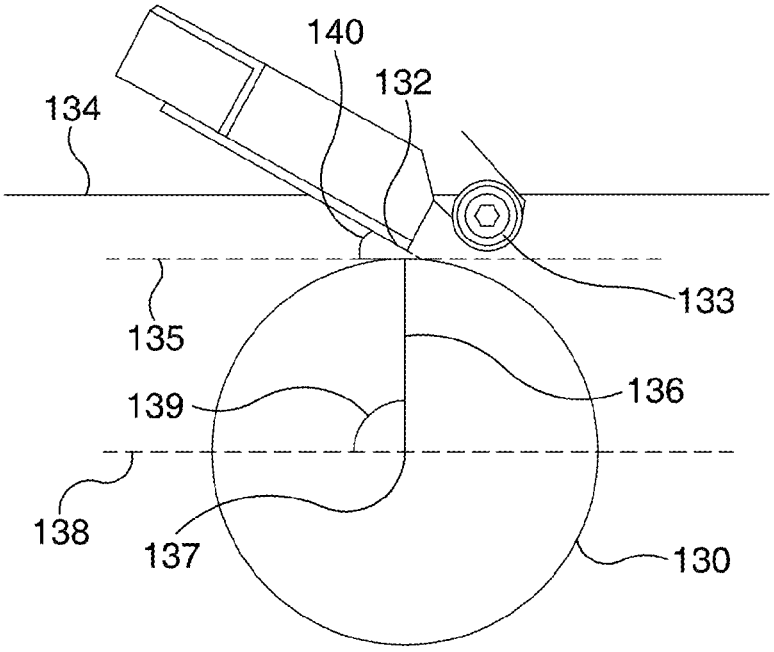
FIG. 5 is a view showing angular position of a printhead relative to a platen roller.

FIG. 5 shows a platen roller 130, a printhead edge 132 and a peel off roller 133 which is arranged to direct the ribbon away from the print path after printing. A line 134 represents an adjacent edge of the cover plate 21. A broken line 135 represents the position of a tangent to the roller 130 at the point of closest approach of the printhead edge 132 (it will be appreciated that during printing a substrate and a print ribbon will be interposed between the edge 132 and the roller 130). The line 136 represents a radius extending from the rotation axis 137 of the roller 130. The line 138 represents a notional line through the axis 137 parallel to the edge 134. The line 138 represents no more than a datum direction through the axis 137 from which the angular position of the radius 136 corresponding to angle 139 can be measured.

Angle 140 is the angle of inclination of the printhead relative to the tangent line 135. This angle is critical to the quality of print produced and will typically be specified by the manufacturer as having to be within 1 or 2 degrees of a nominal value such as 30 degrees. Different printheads exhibit different characteristics however and it is desirable to be able to make fine adjustments of say a degree or two of the angle 140.

It will be appreciated that the angle 140 is dependent firstly upon the positioning of the printhead on its support structure and secondly by the position of the tangent line 135. If the printhead was to be moved to the right in FIG. 5, the angular position of the printhead relative to the rotation axis of the roller will change. That angular position is represented by the magnitude of the angle 139. As angle 139 increases, angle 140 decreases. Similarly, if the printhead shown in FIG. 5 was to be moved to the left, the angle 139 representing the angular position of the printhead relative to the rotation axis of the roller would decrease and the angle 140 would increase. This relationship makes it possible for adjustments to be made to the printhead angle by adjusting the position of the print head 4 along a track indicated by arrows 5 in FIG. 1. Such adjustments can be made based upon data indicative of print quality generated by the optical device discussed above.

In another embodiment, the optical device can be used to detect the lateral movement (tracking) of ribbon over time. Such movement may be in a direction generally perpendicular to the intended direction of ribbon movement between the supply and take up spools. For example, if there is a bent shaft or mandrel on the cassette, the ribbon will tend to track to one end of a roller, for example, potentially telescoping and causing the ribbon to break. The printer can issue a warning message to user if the ribbon moves laterally past predetermined limits.

The optical device can also be used to detect the end of the ribbon, to give the user advance warning of when the ribbon needs to be changed. The ribbon can be marked a fixed distance from its end, or can have regular marking along the length in order to provide information about the length of ribbon remaining.

The detected image can be used to detect missing or faulty pixels and thereby adjust the printed image. In one embodiment, the detected image can be combined with data indicative of the resistivity of heating elements of the printhead to determine the status of heating elements of the printhead. For example, methods are known to detect the 'health' or status of individual resistors in a thermal printhead by measuring certain electrical properties thereof. By comparing the intended image with the actual image of the ribbon, the optical device can detect "missing dots" (unprinted pixels on the image) on the ribbon and work either alone or in combination with a system intended to identify faulty heating elements of the printhead to provide one or more of the following features. The printer can shift the image along the printhead to not use the faulty pixels for printing, but rather use the pixels that are determined to be working properly. That is, the image may be printed using only heating elements which are not detected to be faulty.

In another embodiment, the printer can distinguish between missing pixels caused by a dirty printhead and those that are caused by failures in the printhead (such as defective resistance elements). The controller can use the following logic to distinguish between a dirty printhead and a defective printhead. If data generated by the optical device indicates that some pixels have been missed in the printed image and the faulty heating element detection system also indicates a faulty pixel, a faulty printhead message is generated. However, it the optical device indicates a missing pixel, but the faulty heating element detection system does not indicate a failure of the corresponding heating element, then it can be determined that the printhead is likely dirty. The printer can be configured to provide a warning to the user on that distinguishes between the two cases (e.g. "Please Change Printhead" in the former and "Please Clean Printhead" in the latter). The printer can also provide a user-friendly image shown on screen to give a WYSIWYG display of the dead/dirty heating elements or pixels, by showing which are printing properly, which have failed the resistance test, and which appear to be merely dirty.

In another embodiment, the present disclosure provides a device and method for so-called slip mode printing. Slip mode printing is a method of thermal transfer printing in which the printer controller controls the speed of the thermal transfer ribbon to be at a speed less than the speed of the substrate to be printed on. During the same process, the control outputs signals to the thermal transfer printhead to print an image which is similarly reduced in size in the direction of movement of the ribbon and substrate, so that as the thermal transfer prints, the ink is to some extent "smeared" onto the substrate. The desired result is that a full sized image is printed on the substrate, but the amount of ribbon consumed is less than the full size of the image, in the plane of the direction of movement of the ribbon and substrate.

The purpose of slip mode printing is three-fold. This method (i) consumes less ribbon than conventional printing, (ii) is capable of printing onto substrates which are moving at a higher speed than would normally be possible to effect acceptable print quality, given the constraints of the printer and the thermal printing technology and (iii) increases the throughput of the printer since, for a given ribbon acceleration, the lower ribbon speeds needed for slip printing are achieved in a shorter time period.

Printheads used in thermal transfer printing are typically positioned relative to a platen or roller adjacent the substrate to be printed upon. The thermal transfer printing process requires the printhead to be pressed against the substrate, with the thermal transfer ribbon sandwiched between the printhead and the substrate, and the substrate pressed against the platen, roller, or other support. The force or pressure of the printhead against the ribbon and substrate needs to be maintained within predetermined limits in order to provide adequate printing of acceptable print quality and avoid snagging or snapping either the ribbon or the substrate. It can be appreciated, therefore, that when attempting to print in slip mode, the tolerance of printhead pressure is somewhat tighter than during conventional printing, and furthermore, other factors, such as the frictional properties of the ribbon and substrate are material factors which influence successful slip mode printing. Thus an additional amount of precision in setting the printhead pressure is required when setting up a thermal transfer printer to print in slip mode, and furthermore, the setting may need to be different for different types of substrates and ribbons used.

Once the slip mode printer is set and printing, print quality can vary with seemingly subtle changes in the frictional characteristics of the substrate, which may change from batch to batch of even the same type of substrate, or may change due to environmental changes such as ambient temperature and humidity. Print quality can also be adversely influenced by dust or other factors which change the friction and thus the slip of the ribbon relative to the substrate and the printhead. Consequently, slip mode printing without adequate control can prove a somewhat unreliable method of printing consistent quality images on the substrate and can lead to excessive occurrences of ribbon snaps, and/or poor/unacceptable print quality. This in turn can lead to unacceptable printing "downtime" and consequent maintenance and adjustment costs.

In certain instances, the aspired benefits of slip mode printing are more than negated by the level of unreliability or inconsistency of acceptable quality printed images. The primary reason for this is that existing methods of slip mode printing are "open loop," in that the printhead pressure is initially set, but thereafter the pressure is not controlled in response to changes in, for example, the frictional characteristics of the substrate and ribbon, as described above. Consequently, the initial pressure chosen to provide acceptable slip mode printing and print quality can become either too low or too high, in either case causing one or both poor, unacceptable print quality or printer failure—for example, ribbon breakage.

The present disclosure provides a closed loop control method and apparatus for slip mode printing, which, in various embodiments, automatically and/or continuously adjusts the printhead pressure in response to feedback signals which represent a method to determine whether the printhead pressure is tending towards being either too light or too heavy and to maintain the printhead pressure at a level which delivers acceptable print quality within pre-determined limits. The present disclosure also provides a method to control the print image and print quality, including adjusting the darkness of the images, by adjusting the power to individual heating elements of a printhead in response to feedback signals.

Figure 6:
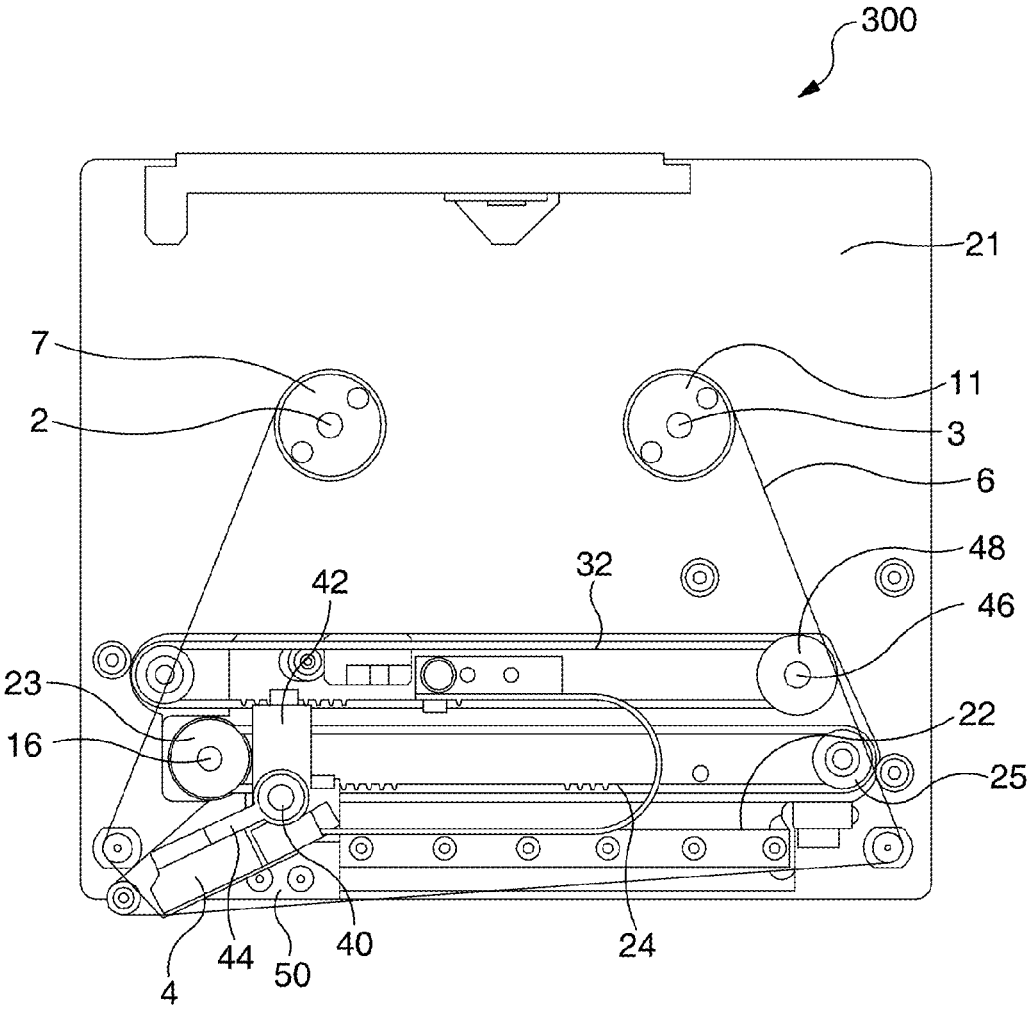
FIG. 6 is a view of an embodiment of a printer with a printhead control system in a first configuration.
Figure 6A:
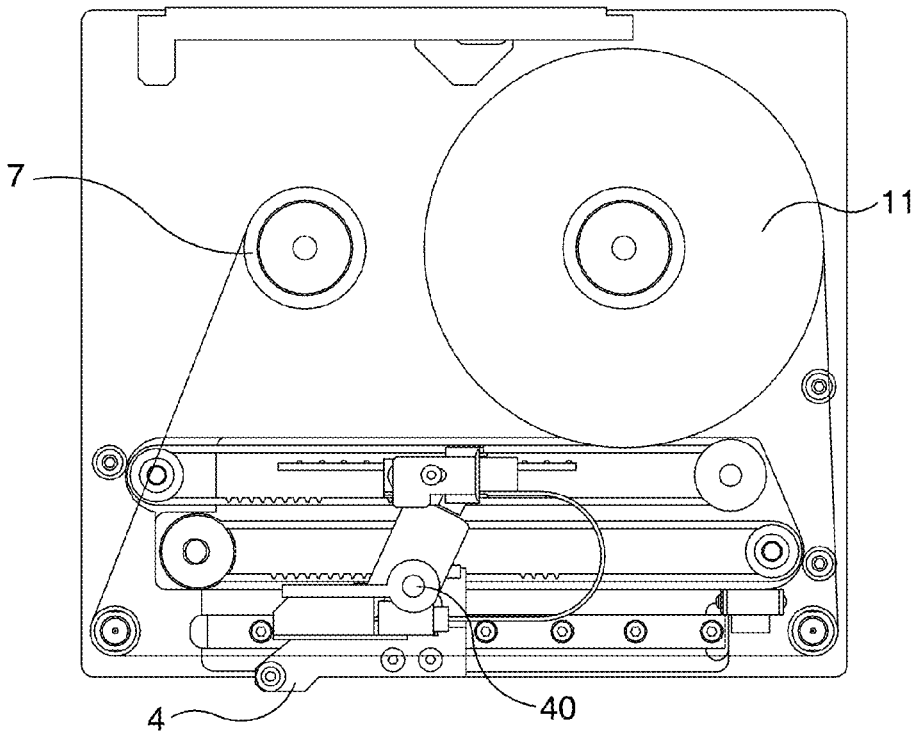
FIG. 6A is a view of the printer of FIG. 6 in a second configuration.

An embodiment of a printer 300 capable of slip mode printing is shown in FIGS. 6 and 6A. FIG. 6 show a printhead 4 in an extended position and FIG. 6A shows a printhead 4 in a retracted position. Various aspects of the printer 300 are similar to that shown in FIG. 1 and use the same component numbering. The printhead 4 is pivotably mounted on a carriage 50 which is displaceable along a linear track 22, which is fixed in position relative to the base plate 21. The stepper motor 16 which controls the position of the printhead assembly 50 is located behind the base plate 21 but drives a pulley wheel 23 that in turn drives a belt 24 extending around a further pulley wheel 25, the belt 24 being secured to the carriage assembly 50. Thus rotation of the pulley wheel 23 in the clockwise direction drives carriage assembly 50 and hence the printhead 4 to the left in FIG. 6 whereas rotation of the pulley wheel 23 in the counterclockwise direction in FIG. 6 drives the printhead assembly 4 to the right in FIG. 6. The pressure of the printhead 4 against the ribbon 6 and the substrate is provided by the movement of a belt 32 attached to one arm 42 of a pivot 40, the other arm 44 of which pivot 40 is attached to the printhead 4. Accurate adjustment of the pressure imparted by printhead 4 is effected by using a motor 46 to control movement of pulley wheel 48 to move the belt 32. Motor 46 is preferably a stepper motor. By stepping the motor 46 (full steps or microsteps) in one direction, belt 32 rotates pivot 40 to position printhead 4 closer to the substrate and pressure is increased, and by stepping the motor 46 in the other direction, belt 32 rotates pivot 40 in the other direction, reducing the pressure of printhead 4. By sensing the stepper motor drive parameters of the motor 46 driving the belt 32, and correlating that as a measure of printhead pressure, fine adjustment of printhead pressure is controlled as is described in further detail below.

One parameter which can be used to sense the printhead pressure is the power consumed by the motor 46 when it is moving, since motor 46 has to work harder to move as the printhead pressure increases, thus consuming more power. This is described with reference to FIG. 8. One method of measuring the power consumed by the stepper motor is to measure the power drawn by a motor drive circuit 200 which drives the stepper motor 46 from a stabilized DC (i.e. constant voltage) power supply 201. In such a case current drawn is a useful indicator of power drawn. This is because, if it is assumed that voltage is constant (which is the case given the nature of the power supply 201) then it will be appreciated that monitored current is proportional to the power consumed by the motor drive 200, the constant of proportionality being given by the constant voltage. While it is the power supplied to the motor 46 which is of interest, if it is assumed that power consumed by the motor drive 200 is negligible compared to power consumed by the motor 46 (which has been found to be a reasonable assumption), monitoring power supplied to the motor drive 200 provides an acceptable approximation of power supplied to the motor 46 itself.

A convenient method of measuring current drawn by the motor drive 200 is to insert a small value resistor 202 (e.g. a resistor having a resistance of 0.3 ohms) in the line between the power supply 201 and the motor drive 200 and measure the voltage drop across the resistor 202 which will be proportional to current drawn given Ohm's law. The voltage drop is applied to a level translator 203 before being passed to an analogue to digital converter 204, the output of which is passed to a microprocessor 205. The microprocessor 205 may be a dedicated to analyzing signals indicative of the power drawn by the motor 46 or may additionally perform additional functions. In particular, as shown in FIG. 8, the microprocessor 205 may provide control signals to the motor drive 200 causing the motor drive 200 to cause the motor 46 to step.

Since modern stepper drive circuits typically drive the motor with pulse width modulation operating at high pulse frequencies (e.g. 50 kHz), it is desirable to filter these switching frequencies out of the voltage drop across the resistor. This is because although the pulse width modulation is applied to connections between the motor drive 200 and the motor 46, the pulse width modulation will have an effect on the current drawn by the motor drive 200 from the power supply 201. The switching frequencies may be filtered by using a low pass filter with a suitable cut off frequency, such as less than 1/10 of the pulse frequency (e.g. a 5 kHz cut off frequency for the pulse frequency of 50 kHz in the previous example).

Figure 8:
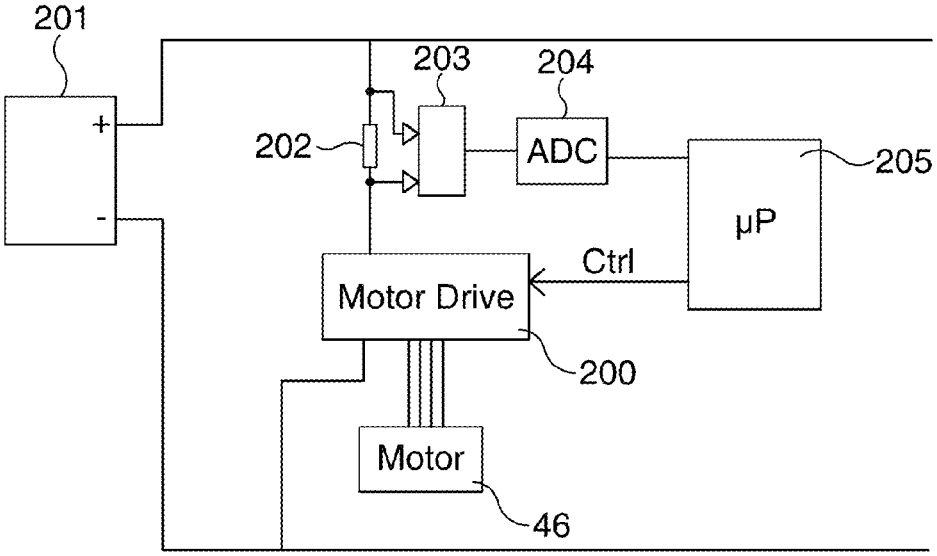
FIG. 8 is a schematic illustration of circuitry associated with a stepper motor arranged to rotate a printhead about a pivot in the printer of FIGS. 6, 6A and 7.

Monitoring the power supplied to the motor drive 200 using the circuit of FIG. 8 has been found to be useful in determining when the platen contacts the roller. Further techniques (described below) can then be used to control the motor following contact between the printhead and the roller.

It will be appreciated that once the correct head pressure has been established by the stepper motor 46, an intermittent print stroke can be performed by rotating both motors 46 and 16 in a counterclockwise direction to provide substantially the same linear belt speed. In this way the printhead can be moved along the linear track while maintaining head pressure.

Figure 7:
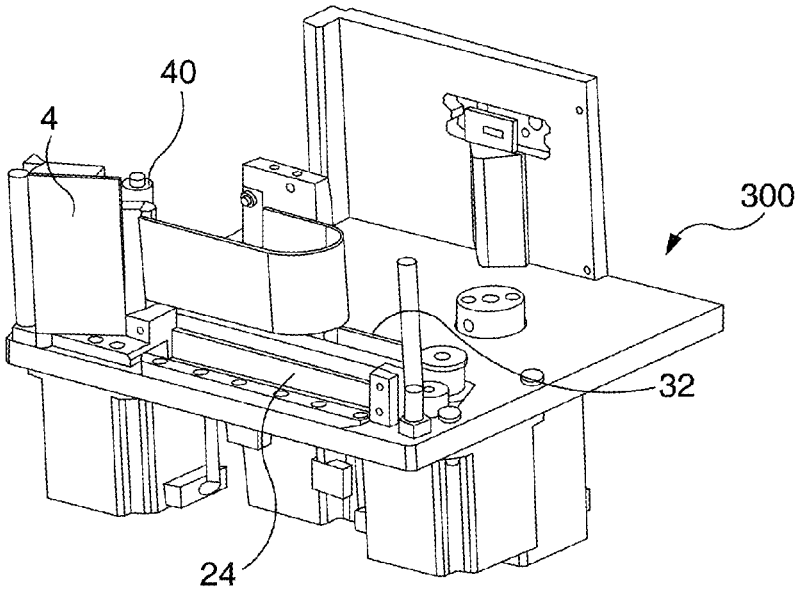
FIG. 7 is a perspective view of the printer system of FIGS. 6 and 6A.

The belt drive system shown in FIGS. 6 and 7 provides significant advantages. Since no compressed air is required, it is easy to integrate into the production lines where thermal transfer printers are typically used. The design reduces printhead bounce since the head position is precisely controlled, compared to prior art air driven systems than only control the force of the printhead. Additionally, the printhead 4 can be lifted as much or little as desired between prints, allowing higher throughput; since the printhead can be moved a shorter distance, it can be done more quickly.

The printer 300 may use a variety of feedback signals to control the operation of the printhead. In one embodiment, the system includes an optical device (as previously described), for example a camera, capturing images of the spent section of ribbon between the printhead and the ribbon rewind spool. In another embodiment, the system uses feedback from the operating conditions of the ribbon drive system. For example, the feedback may include the work done, back emf, temperature and other feedback signals from the ribbon supply spool stepper motor, the ribbon take-up spool stepper motor, or both. Each signal represents one facet of the printing and tape drive and tape movement process.

When using an optical device such as a camera, the camera images detect the "grey scale" of the "negative" image on the spent ribbon. It can be appreciated that if the printhead pressure is too weak, the thermal printhead will be depositing less ink onto the substrate, leaving more ink on the spent ribbon, thus the spent ribbon image captured by the camera will appear darker grey than desired. The control system responds to this signal by way of a suitable PID or other control algorithm, and causes the printhead pivot stepper motor to rotate a calculated number of steps in order to increase or decrease the pressure in order to maintain the amount of ink being deposited from the ribbon within pre-determined limits.

If, on the contrary, the printhead pressure too high it may begin to cause slip between the ribbon and substrate to be more difficult (more frictional), then the ribbon spool drive motors' feedback signals will show a corresponding change as those motors work harder to push-pull the ribbon between the spools. The control system responds to these feedback signals by way of the PID or other control algorithm to step the printhead pivot motor a calculated number of steps in the direction necessary to lessen the printhead pressure on the ribbon and the substrate.

By virtue of this control algorithm, it can be appreciated that the printhead pressure can be adjusted in response to the feedback signals so as to continuously deliver printhead pressure that in turn delivers adequate slip mode printing of acceptable quality images throughout the operational run of the printer. Thus an auto-correcting, closed loop controlled slip mode printing method and apparatus delivers the benefits of slip mode printing, whilst removing the causes of failure or unacceptable print quality.

Similar control mechanisms for controlling the power to individual heating elements of the printhead may be used in combination with, or separately from, the previously described printhead pressure control methods. In particular, if the image (or portions thereof) on the spent ribbon detected by the optical device is lighter or darker than desired, the energy provided to the heating elements of the printhead may be adjusted to improve the image quality.

In another aspect, a print system provides precise control of the pressure exerted by the printhead against the ribbon and the substrate. Existing techniques use an air cylinder to control the pressure of the printhead. In existing arrangements, the air cylinder pressure may be set too high, which can cause premature failure of the ribbon and/or printhead. When moving the printhead against a platen, it is desirable to detect the touch point of the printhead against the platen. In one embodiment, a load cell (or other suitable force measurement device known in the art) is provided in the printhead or the roller/platen that would notify the user when the desired force was reached at a certain position.

It has been explained above that the force applied by the printhead to the platen roller can be monitored by monitoring the power supplied to the motor 46 (or by monitoring a quantity in an approximately known relationship to the power supplied to the motor 46). As the motor runs, the current starts low and then peaks when the printhead contacts the platen. Based on calibration techniques a number of steps through which the controller should cause the motor 46 can to turn can be known such that the printhead exerts the desired force on the platen.

Figure 9:
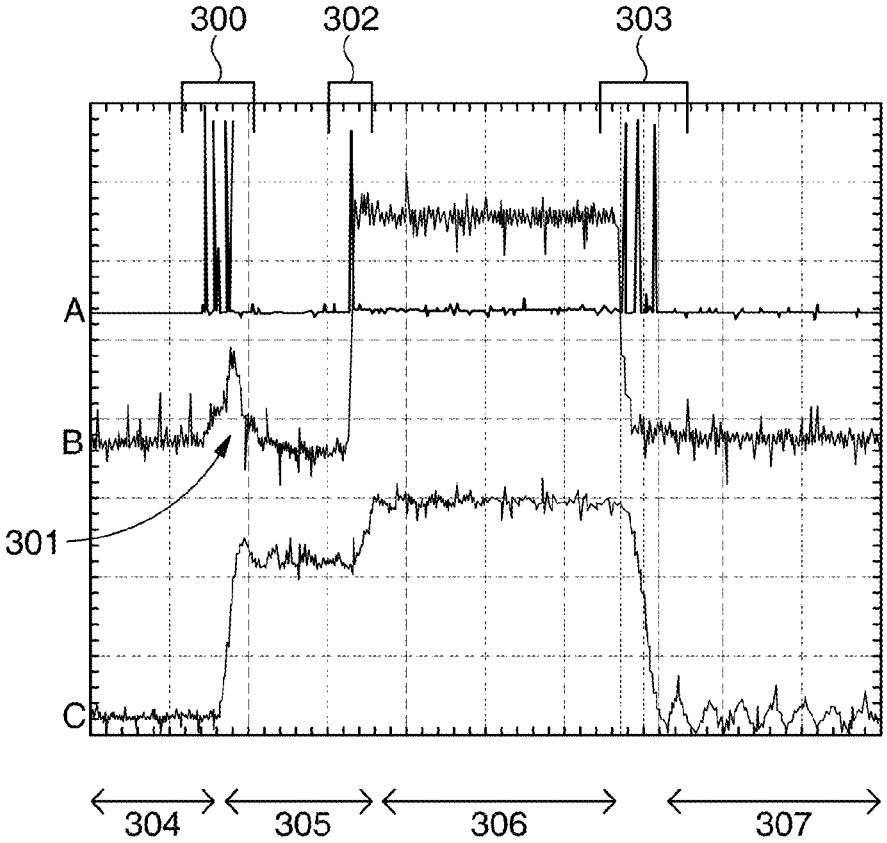
FIG. 9 is a graph showing control pulses applied to the stepper motor of FIG. 8 and associated measurements of voltage and pressure.

In further detail, FIG. 9 shows three oscilloscope traces. A first trace labeled A shows a step command signal provided from the microprocessor 205 to the motor drive 200. A second trace labeled B shows the monitored voltage drop across the resistor 202.

As steps 300 are applied to the motor 46 the printhead approaches then meets the platen. It can be seen from the second trace B that the voltage drop across (and therefore the current through) the resistor 202 increases at 301 indicating that the printhead has contacted the platen. This can be sensed by the microprocessor 205 by comparing the monitored voltage drop to a predetermined threshold. Thereafter a series of further steps 302 is applied to the motor 46 to cause the pressure exerted by the printhead against the platen to increase. The number of steps to be applied can be determined using a feedback mechanism using a loadcell sensing the pressure exerted by the printhead on the platen. In this way one or more steps can be applied, a reading can be taken from the loadcell and a determination can be made as to whether further steps should be applied. Alternatively, the number of steps to be applied can be known from prior determination that a particular force requires application of a particular number of steps.

Figure 10:
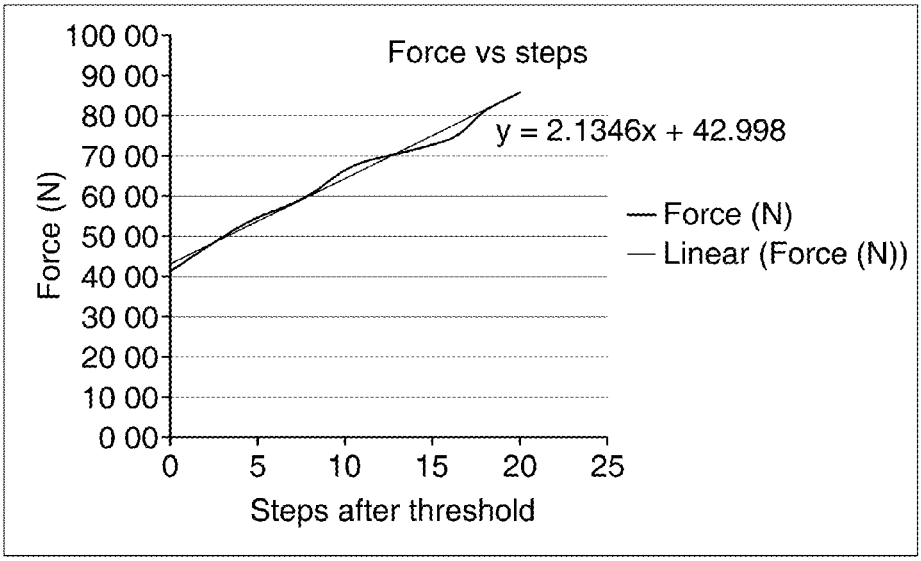
FIG. 10 is a graph showing a relationship between steps applied to a stepper motor and resultant printhead pressure.

For example, in one embodiment, optimal printing occurs when there is a 40N force applied by the printhead to the platen. FIG. 10 is a graph showing the relationship between the number of steps applied to the motor 46 after the threshold is reached and the resultant force. This data was obtained experimentally using a loadcell measuring the force applied to the platen by the printhead and from this data one can derive the following, approximate relationship between steps applied and force applied:

$$\text{Force}=2.1346\text{steps}+42.998 \quad (2)$$

In one embodiment, the current with which the motor drive 200 drives the motor 46 is set by an input to the motor drive 200. The input may be controlled by the microprocessor 205. Until the threshold is reached indicating contact between the printhead and platen, the motor 46 may be driven at a relatively low current, and thereafter, so as to provide additional torque, the motor 46 may be driven at a higher current. This can be seen in the second trace B in FIG. 9. Indeed increasing the current supplied to the motor increases the torque provided by the motor thereby mitigating against the risk that the motor will stall and making it more likely that the desired pressure will be properly achieved. Indeed, in one embodiment it is ensured that the torque of the motor is such that it is able to provide a force 50% greater than that which is actually required.

FIG. 9 also shows the application of steps 303 to the stepper motor 46 to cause the printhead to retract away from the platen. For the application of the steps 303, the motor 46 is driven at a lower current, as can be seen from the second trace B.

Finally, FIG. 9 includes a third trace C which is the output of a loadcell measuring the force exerted on the platen. It can be seen that during a first time 304 negligible pressure is exerted on the platen. During a second time 305, when the printhead has contacted the platen it can be seen that considerably greater pressure is exerted on the platen, and after application of the steps 302 the pressure applied increases yet further. Following application of the steps 303 the pressure again falls.

This pressure control is also important for slip mode printing. This feature removes the user setting the pressure—the printer does it automatically.

An additional benefit of precise printhead position control is the capability to adjust the position of the printhead when printing on substrates with uneven thicknesses. For example, zipper-sealed plastic bags are formed from sheets of film with the thicker zippers formed across the film. When printing on such a substrate, it would be desirable to be able to move the printhead out of the way of the thicker portions. With the present printhead, the printhead can be quickly adjusted to jump over the zipper, moving it just far enough to allow clearance of the zipper, and then moving back quickly to be able to print. With existing printhead designs, the printhead is either fully extended or fully retracted, with no way to control in between. That is, embodiments allow the position of the printhead to be adjusted to accommodate varying substrate thicknesses and variations in substrate thicknesses.

This precise control can be provided by the twin belt arrangement illustrated in FIG. 3. Alternatively, it can be provided using a single belt arrangement such as that shown in FIG. 11.

Figure 11:
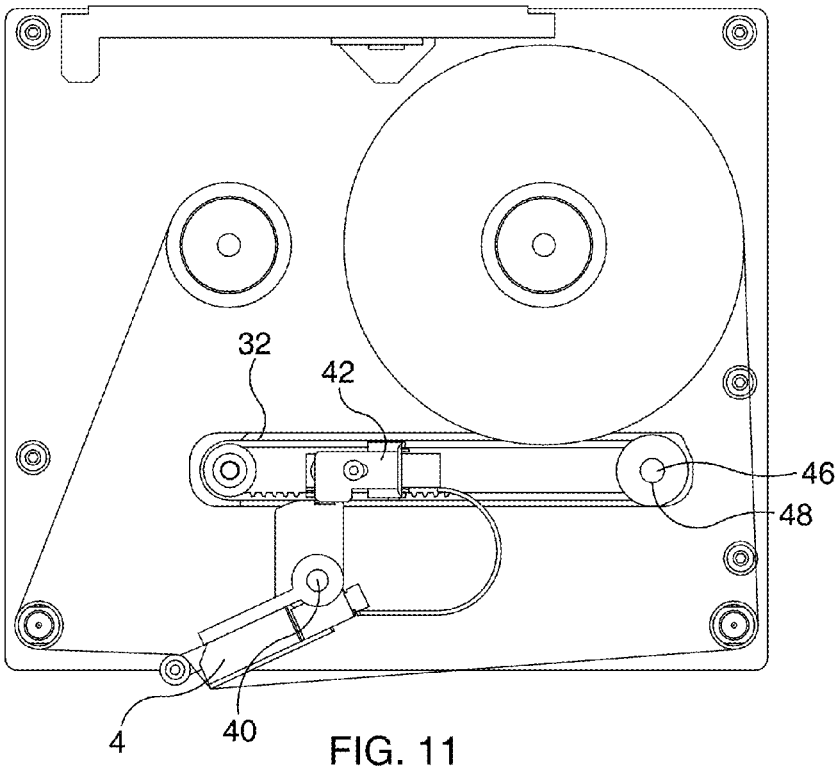
FIG. 11 is a view of an embodiment of a printer with an alternative printhead control system.

In the arrangement of FIG. 11, the printhead is not moveable along a linear track. Such movement is indeed unnecessary in a printer which is to operate solely in continuous mode. However the print head 4 is still arranged to rotate about a pivot 40, the rotation being caused by movement of the arm 42, the arm 42 being moved by the belt 32 which is entrained about a pulley wheel 48 which in turn is driven by the stepper motor 46 as described above. The arrangement of FIG. 11 therefore provides the benefits of accurate pressure control (as described above) but in a printer in which the printhead is not moveable along a linear track.

Figure 12:
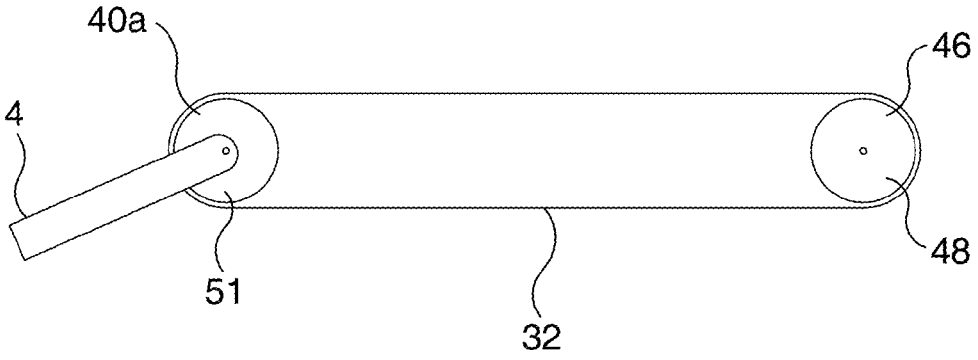
FIG. 12 is a view of an embodiment of a printer with a further alternative printhead control system.

In an alternative embodiment shown in FIG. 12, the printhead 4 rotates about a pivot 40*a* which is coaxial with a roller 51. The belt 32 is entrained about the rollers 48, 51, the roller 48 being driven by a stepper motor as described above.

In each of the embodiments of FIGS. 6, 11 and 12 the printhead is caused to rotate about a pivot by movement of a belt driven by a stepper motor. This introduces some elasticity into the coupling between rotation of the stepper motor and rotation of the printhead about the pivot and such elasticity has been found to provide an effective and reliable way of effecting rotation of the printhead. Indeed, the disclosure foresees that a printhead may be caused to rotate about a pivot by any coupling providing elasticity between drive motor and printhead. In one embodiment the belt 32 is a Synchroflex AT3 belt being 10 mm wide and 351 mm long. The pulleys about which the belt is entrained are both Synchroflex AT3 15 tooth pulleys. It will, however, be appreciated that other belts and pulleys may be used in alternative embodiments.

In alternative embodiments the printhead may be directly coupled to a stepper motor to effect its rotation.

EXAMPLE

A 6400 Videojet Dataflex® printer was modified to include an optical device to provide print quality assessment. A separate PC with a data capture card was used for data capture and processing. It will be appreciated however that the functionality of the PC could be implemented by appropriate hardware within the printer.

Figure 13:
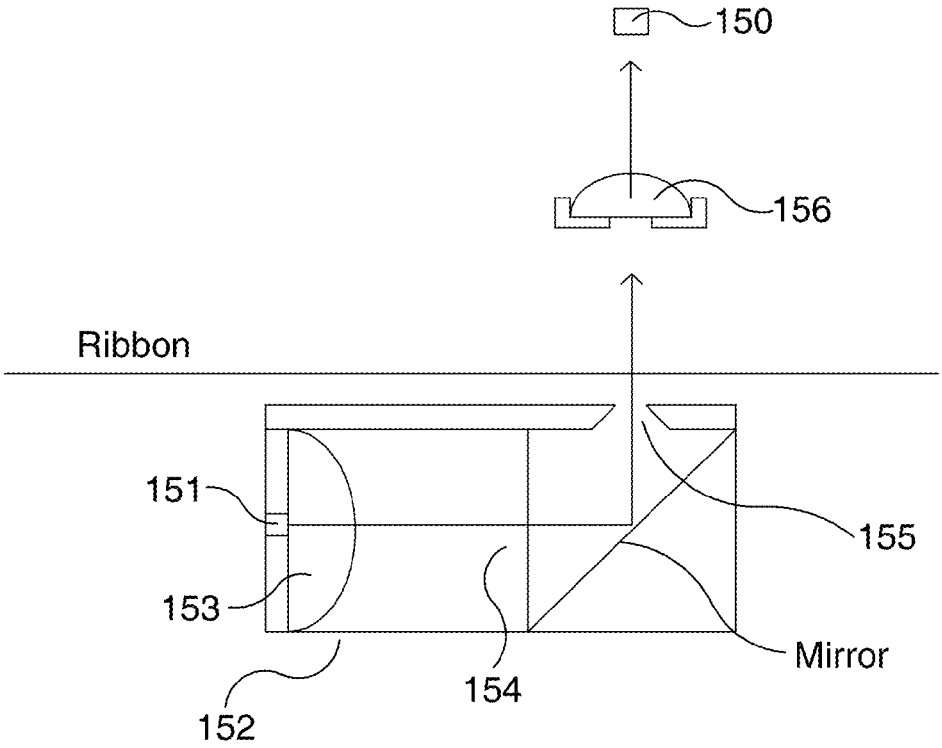
FIG. 13 is a schematic view of an example of an optical device for a printer system.

The optical transmittance of the post-print ribbon was measured by two linear optical detectors 150, as shown schematically in FIG. 13. These detectors 150 were positioned approximately 35 mm above the ribbon. The ribbon was illuminated from below by 8 high-power super-red light emitting diodes 151 emitting light at a wavelength of 645 nm. The light emitting diodes 151 were housed within a light box 152 underneath the printer ribbon. The light traveled from the light emitting diodes through a focusing acrylic half rod 153 and a lenticular diffuser 154. The diffuser maintained focus from the light emitting diodes along the length of the ribbon but diffused the light across the width of the ribbon to ensure even illumination across the ribbon's width. The light exited the light box through a narrow slit 155 in the top of the box. The ribbon covered this slit which minimized the risk of contamination. The optical sensors 150 and a planoconvex focusing lens 156 were positioned above the ribbon. The optical sensors used 256 photodiodes to image the ribbon. The Videojet Dataflex® printer prints at 300 dpi. For a 55 mm ribbon (650 ribbon pixels) each photodiode measured the light from three ribbon pixels. The signal to noise ratio was sufficient to detect a single pixel failure.

The control electronics consists of three elements: the power supply, the sensor control logic and the stepper motor signal processing unit. The power supply generates a +5V supply, a −5V supply and 8 constant current source supplies for the LEDs. A potentiometer was included to allow the LED brightness to be varied. The TAOS linear sensor arrays required a 5V supply voltage, a 1.5 MHz clock and a serial input (SI) signal. The control logic produced the 1.5 MHz clock and the SI signal from a 12 MHz crystal oscillator. A rising edge on SI occurred every 160 clock cycles and triggered the output of data from the sensors. This data was passed to the PC.

The stepper motor signal processing unit multiplexed the stepper motor signals from the main printer PCB and passed these signals to the PC. The test rig the stepper motor and sensor data were captured and processed by an external PC fitted with an Adlink PCIe 2010 data acquisition card.

The optical print quality assessment technology used an algorithm to demonstrate how print errors can be identified. The stepper motor signals from the printer were used to track the ribbon and the printhead during printing. These movements were then combined to give the ribbon's position relative to the optical sensors at all times. This information was used to match the images recorded by the optical sensors to their true position along the ribbon. The sensor image of points every 200 μm along the ribbon was extracted and placed into a new image in the correct order. This provides the detected image data. The sum of the print darkness is taken for each vertical line in the detected ribbon image. These values were then compared to the expected image data.

Figure 14A:
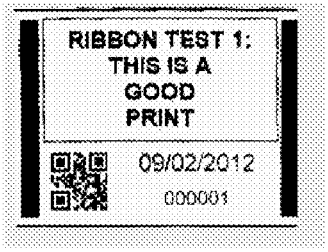
FIG. 14A shows an embodiment of an expected print image.
Figure 14B:
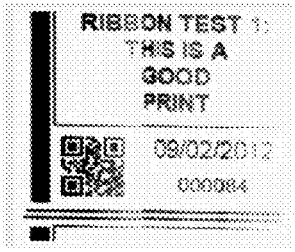
FIG. 14B shows the detected image of FIG. 14A.
Figure 15A:
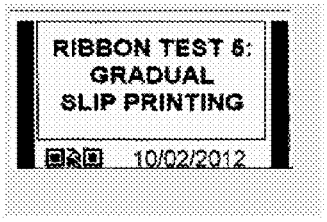
FIG. 15A shows an embodiment of an expected print image.
Figure 15B:
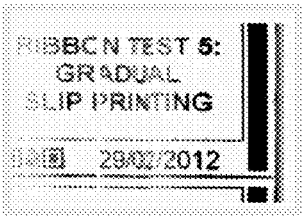
FIG. 15B shows the detected image of FIG. 15A with a failed pixel.
Figure 16A:
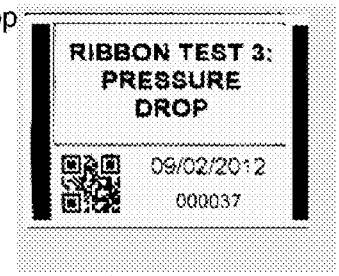
FIG. 16A shows an embodiment of an expected print image.
Figure 16B:
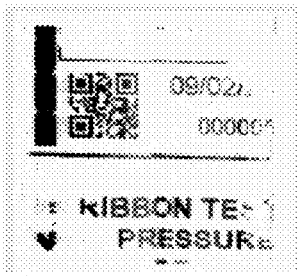
FIG. 16B shows the detected image of FIG. 16A with a pressure drop.
Figure 17A:
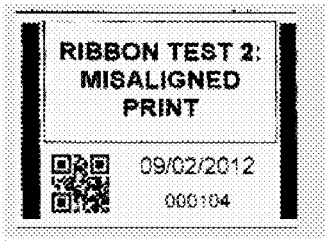
FIG. 17A shows an embodiment of an expected print image.
Figure 17B:
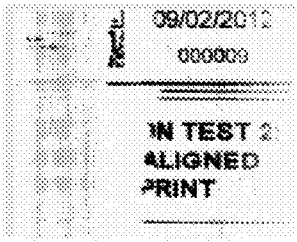
FIG. 17B shows the detected image of FIG. 17A with a misaligned printhead.

The print quality assessment technology enabled the detection of the following print failure modes: a failed printhead pixel, a misaligned printhead, a misprint, and a drop in the printhead pressure. FIGS. 14A and 14B compare the expected and sensed data for a good print. FIGS. 15A to 17B illustrates images of the expected amount of ink remaining on the ribbon after printing has occurred (expected print) with the actual amount remaining after a failed printing (sensed print). The image defects for the failed prints can be clearly seen. FIGS. 15A and 15B show a failed pixel, FIGS. 16A and 16B show a printhead pressure drop, and FIGS. 17A and 17B show a misaligned printhead.

Figure 18:
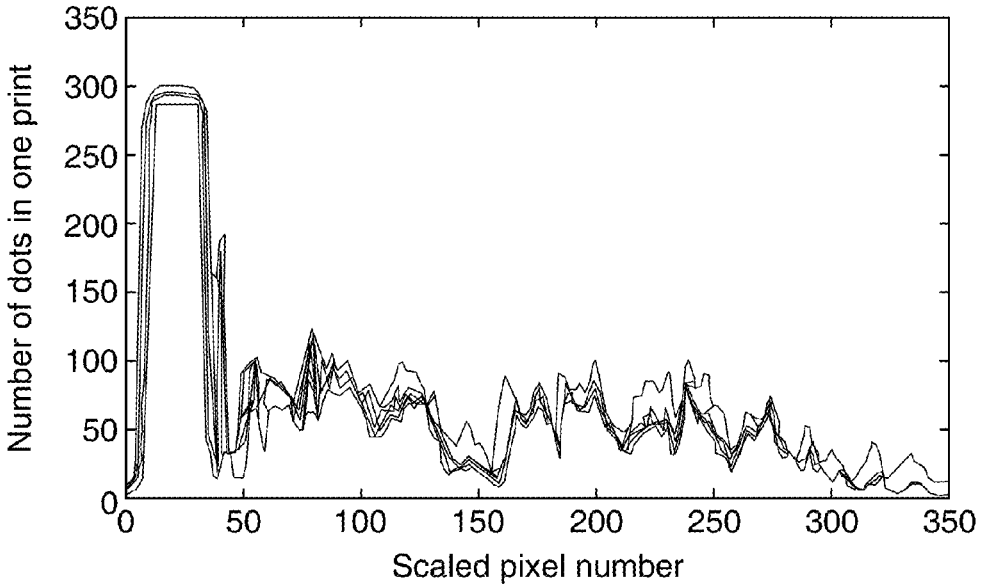
FIG. 18 is a graph showing a comparison between the actual data and the measured data for a good print in Example 1.
Figure 19:
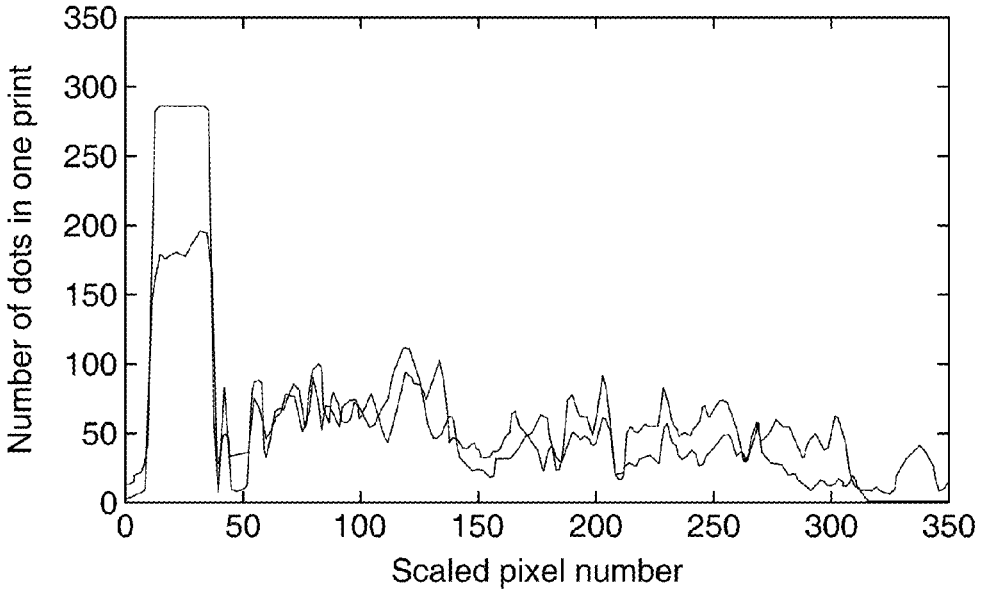
FIG. 19 is a graph showing a comparison between the actual data and the measured data for a print with pressure drop in Example 1.

FIGS. 18 and 19 show graphical comparison of the expected data and the sensed data which was used to identify print errors and evaluate sensor reproducibility. FIG. 18 compares the expected and sensed data for a good print Correlation between the expected and sensor data is clear. Seventeen distinct sensor data traces are plotted. The sensor data shows good reproducibility. FIG. 19 compares the expected and sensed data for the 'printhead pressure drop' failure mode. The reduction in image intensity in the sensor data is shown.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Where reference has been made herein to the movement of a stepper motor through a 'step' it will be appreciated that the term 'step' is intended broadly to cover both a complete step defined by the construction of the stepper motor and sub-steps through which the motor can be controlled to move using well-known micro stepping techniques. For example, in some embodiments the motor 46 (FIG. 3) is stepped through $1/8^{th}$ microsteps.

Where references have been made to stepper motors herein, it will be appreciated that motors other than stepper motors could be used in alternative embodiments. Indeed, stepper motors are an example of a class of motors referred to position-controlled motors. A position-controlled motor is a motor controlled by a demanded output rotary position. That is, the output position may be varied on demand, or the output rotational velocity may be varied by control of the speed at which the demanded output rotary position changes. A stepper motor is an open loop position-controlled motor. That is, a stepper motor is supplied with an input signal relating to a demanded rotation position or rotational velocity and the stepper motor is driven to achieve the demanded position or velocity.

Some position-controlled motors are provided with an encoder providing a feedback signal indicative of the actual position or velocity of the motor. The feedback signal may be used to generate an error signal by comparison with the demanded output rotary position (or velocity), the error signal being used to drive the motor to minimise the error. A stepper motor provided with an encoder in this manner may form part of a closed loop position-controlled motor.

An alternative form of closed loop position-controlled motor comprises a DC motor provided with an encoder. The output from the encoder provides a feedback signal from which an error signal can be generated when the feedback signal is compared to a demanded output rotary position (or velocity), the error signal being used to drive the motor to minimise the error.

It will be appreciated from the foregoing that various position controlled motors are known and can be employed in embodiments of a printing apparatus. It will further be appreciated that in yet further embodiments conventional DC motors may be used.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non volatile storage). Alternatively or additionally control may be provided by other control hardware such as, but not limited to, application specific integrated circuits (ASICs) and/or one or more appropriately configured field programmable gate arrays (FPGAs).

While various disclosures herein describe that each of two tape spools is driven by a respective motor, it will be appreciated that in alternative embodiments tape may be transported between the spools in a different manner. For example a capstan roller located between the two spools may be used. Additionally or alternatively, the supply spool may be arranged to provide a mechanical resistance to tape movement, thereby generating tension in the tape.

Where references have been made herein to detecting light incident upon an optical sensor, it should be appreciated that other forms of electromagnetic radiation could be used in some embodiments of the invention. That is, there is no requirement that the sensor detects visible light.

Where references have been made herein to generating data based upon properties of the ribbon sensed after printing, in other embodiments such data may be generated based upon properties of the printed image. That is, data may be generated from the substrate after printing has been carried out. Such data may then be used analogously to that obtained from the ribbon after printing, as has been described herein. In particular, where reference has been made herein to generating data indicating and/or based upon a quantity of ink remaining on ribbon after printing, similar data can be generated indicating and/or based upon a quantity of ink deposited on the substrate after printing.

References have been made herein to determining the quantity of ink remaining on the ribbon after printing using optical methods. Other methods can also be used. For example, in some embodiments, a quantity of ink remaining on the ribbon after printing may be determined using a capacitive sensor arranged to generate data from the ribbon.

References have been made to monitoring of an optimization of print quality. Such print quality can be monitored in any convenient way, and various ways have been described herein. In particular, print quality may be defined based upon a number of pixels printed which correspond to the pixels intended to be printed. Alternatively or additionally print quality may be defined by comparing a total number of pixels printed in an image with a number of pixels intended to be printed. In some embodiments a print quality metric may be based upon a relative darkness of the printed image (or relative "lightness" of ribbon after printing).

The invention claimed is:

1. A thermal transfer printer, comprising:

first and second spool supports each being configured to support a spool of ribbon;

a ribbon drive configured to cause movement of ribbon from the first support to the second spool support;

a printhead configured to selectively transfer ink from the ribbon to a substrate;

an electromagnetic sensor arranged to sense electromagnetic radiation associated with a spent section of the ribbon after ink has been transferred to the substrate forming the spent section of the ribbon and when the spent section of the ribbon is located between the printhead and the first spool support or the second spool support and the electromagnetic sensor is arranged to generate data indicative of a quantity of ink remaining on the spent section of the ribbon based upon a sensed electromagnetic radiation of the spent section of the ribbon; and a controller for processing data generated by the electromagnetic sensor and using the data generated by the electromagnetic sensor to generate data indicating whether a printed image has acceptable quality, wherein the controller is configured to control a property of the printer based on the data generated by the electromagnetic sensor, where the property of the printer is selected from a printhead pressure parameter, print speed, and printhead temperature.

2. The thermal transfer printer of claim 1, wherein the sensed electromagnetic radiation is selected from the group consisting of electromagnetic transmittance and electromagnetic reflectance.

3. The thermal transfer printer of claim 1, wherein the electromagnetic sensor comprises a camera.

4. The thermal transfer printer of claim 1, wherein the electromagnetic sensor comprises an electromagnetic detector.

5. The thermal transfer printer of claim 1 further comprising a source of electromagnetic radiation for applying electromagnetic radiation to the ribbon.

6. The thermal transfer printer of claim 5 wherein a ribbon path between the first and second spools passes between said source of electromagnetic radiation and said electromagnetic sensor, and the electromagnetic sensor detects optical transmittance of electromagnetic radiation from the source of electromagnetic radiation to the electromagnetic sensor through the ribbon.

7. The thermal transfer printer of claim 1 wherein the controller is configured to receive signals indicative of an image that is intended to be printed onto the substrate.

8. The thermal transfer printer of claim 1, wherein the first and second spools are driven by respective motors.

9. The thermal transfer printer of claim 8, wherein at least one of the motors is a stepper motor.

10. The thermal transfer printer of claim 1, wherein the controller is configured to control properties of the printer based on data generated by the electromagnetic sensor.

11. The thermal transfer printer of claim 1 where the property of the printer is a printhead pressure parameter.

12. The thermal transfer printer of claim 1 wherein the electromagnetic sensor is configured to read data from the ribbon, the data conveying information about the properties of the ribbon.

13. The thermal transfer printer of claim 12, wherein the properties of the ribbon are selected from the ribbon length, width, thickness, color, and ink type.

14. The thermal transfer printer of claim 12 where the data is a bar code.

15. The thermal transfer printer of claim 1 wherein the controller is configured to determine a diameter of at least one of the spools of tape supported by the spool supports based upon data generated by the electromagnetic sensor.

16. The thermal transfer printer of claim 15 where the data generated by the electromagnetic sensor comprises data generated by sensing at least two marks disposed a predetermined distance apart along a length of the ribbon.

17. The thermal transfer printer of claim 16, wherein the controller is configured to:

monitor rotation of the at least one of the spools to generate rotation data; and determine a diameter of the at least one of the spools by processing data generated by sensing at least two marks disposed a predetermined distance apart along the length of the ribbon together with said rotation data.

18. A method of using the thermal transfer printer of claim 1, comprising:

causing movement of ribbon from the first support to the second spool support;

using the printhead to selectively transfer ink from the ribbon to the substrate;

sensing electromagnetic radiation with the electromagnetic sensor from the spent section of the ribbon after ink has been transferred to the substrate and when the spent section of the ribbon is between the printhead and the second spool support, and generating data indicative of a property of the ribbon based upon sensed electromagnetic radiation;

using the controller to process data generated by the electromagnetic sensor; and using the data generated by the electromagnetic sensor to generate data indicating whether a printed image has acceptable quality.

* * * * *